US012781314B2

(12) United States Patent
Muralidharan et al.

(10) Patent No.: US 12,781,314 B2
(45) Date of Patent: Nov. 3, 2026

(54) MAGNESIUM ALLOYS FOR THIXOMOLDING APPLICATIONS

(71) Applicants: UT-Battelle, LLC, Oak Ridge, TN (US); Leggera Technologies LLC, Orion Township, MI (US); FCA US LLC, Auburn Hills, MI (US)

(72) Inventors: Govindarajan Muralidharan, Knoxville, TN (US); Bryan Macek, Auburn Hills, MI (US); Nathan Sanko, Orion Township, MI (US)

(73) Assignees: UT-BATTELLE, LLC, Oak Ridge, TN (US); LEGGERA TECHNOLOGIES LLC, Orion Township, MI (US); FCA US LLC, Auburn Hills, MI (US)

( * ) Notice: Subject to any disclaimer, the term of this patent is extended or adjusted under 35 U.S.C. 154(b) by 429 days.

(21) Appl. No.: 18/375,301

(22) Filed: Sep. 29, 2023

(65) Prior Publication Data

US 2024/0200173 A1 Jun. 20, 2024

Related U.S. Application Data

(60) Provisional application No. 63/433,077, filed on Dec. 16, 2022.

(51) Int. Cl.
*C22C 23/02* (2006.01)
*B22D 21/00* (2006.01)

(52) U.S. Cl.
CPC ..... *C22C 23/02* (2013.01); *B22D 21/007* (2013.01)

(58) Field of Classification Search
CPC ..... C22C 23/02; C22F 1/06; B22D 21/007
See application file for complete search history.

(56) References Cited

U.S. PATENT DOCUMENTS

| | | | | |
|---|---|---|---|---|
| 5,223,347 | A | 6/1993 | Lhymn et al. | |
| 8,333,924 | B2 | 12/2012 | Kawamura et al. | |
| 2008/0193322 | A1 | 8/2008 | Gibson et al. | |
| 2009/0196787 | A1* | 8/2009 | Beals | C22C 23/02 420/405 |
| 2017/0129006 | A1 | 5/2017 | Bronfin et al. | |

FOREIGN PATENT DOCUMENTS

KR 101744432 B1 6/2017

OTHER PUBLICATIONS

Czerwinski, "Processing features of thixomolding magnesium alloys", Die Casting Engineer (Nov. 2004).
International Search Report and Written Opinion mailed on Mar. 12, 2024 in PCT/US23/34202.

* cited by examiner

*Primary Examiner* — Jessee R Roe
(74) *Attorney, Agent, or Firm* — Fox Rothschild LLP

(57) ABSTRACT

A magnesium alloy includes, in weight percent Al: 4.5-6.5; Zn: 0.05-3.0; Ca: 0-1.5; Sn: 0-4.0; Mn: 0.1-0.5; Si: 0-0.5; B+Sr: 0-0.5; less than 0.1 Fe; less than 0.1 Cu; less than 0.01 Ni; and Mg: Balance. A process for thixomolding, and a large dimension magnesium alloy article are also disclosed.

16 Claims, 46 Drawing Sheets

MAGNESIUM ALLOYS FOR THIXOMOLDING APPLICATIONS

CROSS-REFERENCE TO RELATED APPLICATIONS

This application claims priority to U.S. 63/433,077 filed on Dec. 16, 2022, entitled "Magnesium Alloys for Thixomolding Applications", the entire disclosure of which incorporated herein by reference.

STATEMENT REGARDING FEDERALLY SPONSORED RESEARCH AND DEVELOPMENT

This invention was made with government support under Contract No. DE-AC05-00OR22725 awarded by the U.S. Department of Energy. The government has certain rights in this invention.

FIELD OF THE INVENTION

The present invention relates generally to thixomolding, and more particularly to alloys for thixomolding applications.

BACKGROUND OF THE INVENTION

Magnesium-alloy die-castings are being increasingly used in the automobile industry as a means of providing cost effective mass reduction, especially in systems where multiple components can be integrated into a single thin-wall die-casting. However, there is only one die-caster in North America capable of producing die-castings of the size needed for instrument panel structures, liftgate inner panels, swing gate inner panels, and similar components, thus making it difficult to negotiate competitive pricing and creating a supply chain risk. Furthermore, there are several component quality restrictions in thin-walled magnesium die-castings including variability in dimensional accuracy, part-to-part variation in mechanical properties, and porosity in the final part which has limited the continued growth of die-cast components in the automobile industry.

An alternative to die-casting is the process of thixomolding. Widely used in the electronics industry, the thixomolding process has begun to make inroads into the automobile industry as a competing process to die-casting for producing complex thin-wall magnesium components. While the thixomolding process is somewhat similar to the die-casting process, it differs in at least one significant aspect. While the die-casting process relies on filling a mold at high speeds with the alloy in the completely molten state, the thixomolding process fills a mold with a thixotropic alloy in a semi-solid slurry state at a temperature between the liquidus and solidus temperatures. Ideally, the material should be ~30-65% solid rather than being completely liquid at the beginning of the injection process. Advantages of the thixomolding process include finer grain structure, lower porosity, improved dimensional accuracy, improved part-to-part consistency, improved mechanical properties, particularly ductility in the component, ability to reduce wall thickness for mass savings, and longer tool life due to lower process temperatures.

Although thixomolding offers improved mechanical properties over die-cast Mg components, the mechanical properties obtained in the thixomolded parts are still not sufficient to broadly enable application in components where both strength and ductility are key requirements, such as crash critical components exposed to high impact velocities and powertrain or chassis components subjected to high levels of cyclic loading. Currently, the mechanical properties are limited by the alloys being used, which are often the same alloys that are used in the die-casting process. Thus there is a need for the development of new alloys which can achieve high strengths with improved ductilities for use in components fabricated by the thixomolding process.

Alloys currently used have one or more drawbacks. The alloy AZ91D is a very popular die-casting alloy with good processability and has good strength but low ductility. The alloy AM60B is another popular alloy with good strength and ductility but has only a narrow processing range. It would be desirable to provide an alloy with good processability comparable to AZ91D, strength comparable to AM60B, and with improved ductility.

TABLE 1

Currently used alloys and their properties.

| Alloy | Mg | Al | Zn | Mn | Yield Strength (MPa) | Elongation |
|---|---|---|---|---|---|---|
| AM60B | Bal | 6 | 0.2 | 0.3 | 121 | 16 |
| AZ91D | Bal | 9 | 0.7 | 0.3 | 158 | 6 |

These existing alloys have been primarily designed for injection molding in liquid state for die casting. Components thixomolded with die casting alloys do not have balanced properties. As seen in Table 1, AZ91D has good processing characteristics, high strength, but poor ductility, while AM60B has good ductility but needs improvement in strength and processing characteristics. This is illustrated in FIG. 1. FIG. 2 illustrates that AZ91D has high strength, lower solidus and wider melting range than AM60 (F. Czerwinski, Die Casting Engineer, November 2004).

SUMMARY OF THE INVENTION

A magnesium alloy comprises on weight percent, Al: 4.5-6.5; Zn: 0.05-3.0; Ca: 0-1.5; Sn: 0-4.0; Mn: 0.1-0.5; Si: 0-0.5; B+Sr: 0-0.5; less than 0.1 Fe; less than 0.1 Cu; less than 0.01 Ni; and Mg: balance. The magnesium can consist essentially of, in weight percent, Al: 4.5-6.5; Zn: 0.05-3.0; Ca: 0-1.5; Sn: 0-4.0; Mn: 0.1-0.5; Si: 0-0.5; B+Sr: 0-0.5; less than 0.1 Fe; less than 0.1 Cu; less than 0.01 Ni; and Mg: balance. The magnesium alloy can consist of, in weight percent, Al: 4.5-6.5; Zn: 0.05-3.0; Ca: 0-1.5; Sn: 0-4.0; Mn: 0.1-0.5; Si: 0-0.5; B+Sr: 0-0.5; less than 0.1 Fe; less than 0.1 Cu; less than 0.01 Ni; and Mg: balance. The magnesium alloy can have a processability index P of 20 to 150.

The magnesium alloy can have a Ge content of from 0-0.5 wt. % Ge. The magnesium alloy can have a Li content of from 0-0.5 wt. % Li.

The magnesium alloy can have a yield strength of at least 90 MPa. The magnesium alloy can have a yield strength of at least 100 MPa. The magnesium alloy can have a yield strength of at least 120 MPa.

The magnesium alloy can have an elongation to failure is at least 16%. The magnesium alloy can have an elongation to failure is at least 20%.

The magnesium alloy can have a melting range of at least 200° C. The magnesium alloy can have a melting range of at least 175° C. The magnesium alloy can have a melting range of at least 150° C. The magnesium alloy can have a melting range of at least 135° C.

A method of preparing a thixomolded article can include the step of providing a magnesium alloy comprising, in weight percent Al: 4.5-6.5; Zn: 0.05-3.0; Ca: 0-1.5; Sn: 0-4.0; Mn: 0.1-0.5; Si: 0-0.5; B+Sr: 0-0.5; less than 0.1 Fe; less than 0.1 Cu; less than 0.01 Ni; and Mg: balance. The magnesium alloy is heated to a temperature of 500-600° C., producing a thixotropic alloy comprising 30-65 weight % solids. The thixotropic alloy is introduced into a mold under a pressure of 50-100 MPa. The thixotropic alloy is allowed to cool to produce a solid thixomolded article.

A method of preparing a thixomolded article can include the step of providing a magnesium alloy comprising, in weight percent Al: 4.5-6.5; Zn: 0.05-3.0; Ca: 0-1.5; Sn: 0-4.0; Mn: 0.1-0.5; Si: 0-0.5; B+Sr: 0-0.5; less than 0.1 Fe; less than 0.1 Cu; less than 0.01 Ni; and Mg: balance. The magnesium alloy is heated to a temperature of 500-600° C., producing a thixotropic alloy comprising 30-65 weight % solids. The thixotropic alloy is introduced into an open mold under ambient pressure. The mold is closed to compress the thixotropic alloy and thus fill the mold. The thixotropic alloy is allowed to cool to produce a solid thixomolded article.

A thixomolded article includes a magnesium alloy comprising, in weight percent Al: 4.5-6.5; Zn: 0.05-3.0; Ca: 0-1.5; Sn: 0-4.0; Mn: 0.1-0.5; Si: 0-0.5; B+Sr: 0-0.5; less than 0.1 Fe; less than 0.1 Cu; less than 0.01 Ni; and Mg: balance. The thixomolded article can have a weight of at least 3.6 kg and an average thickness of between 2.0 mm and 4.0 mm. The thixomolded article can have a largest dimension of between 50 cm and 200 cm. The thixomolded article can contain at least 1 molded-in connecting feature, the connecting feature provides a positive location function and structural strength of at least 70% of the base material strength, and the article is joined with other articles to produce an article with a mass of at least 7.2 kg.

BRIEF DESCRIPTION OF THE DRAWINGS

There are shown in the drawings embodiments that are presently preferred it being understood that the invention is not limited to the arrangements and instrumentalities shown, wherein.

DETAILED DESCRIPTION OF THE INVENTION

Figure 1:
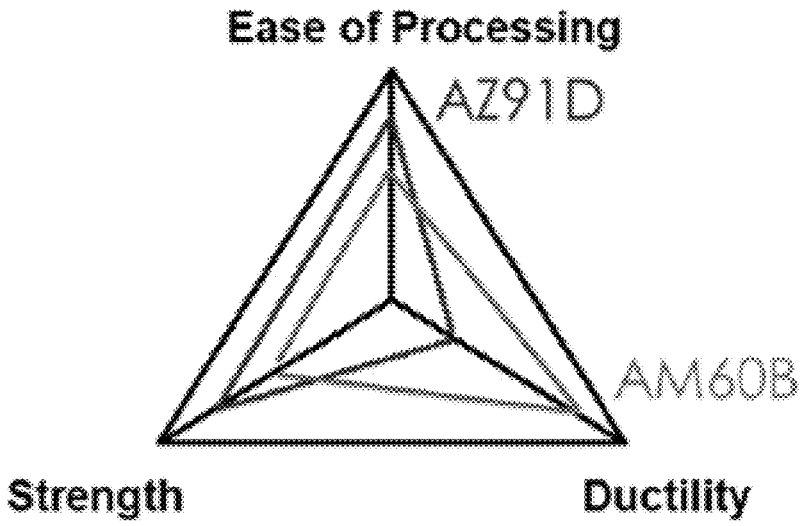
FIG. 1 is a diagram illustrating the strengths and weaknesses of prior art alloys AZ91D and AM60B for strength, ductility, and ease of processing.

A magnesium alloy comprising, in weight percent:
Al: 4.5-6.5;
Zn: 0.1-3.0;
Ca: 0-1.5;
Sn: 0-4.0;
Mn: 0.1-0.5;
Si: 0-0.5;
B+Sr: 0-0.5;
less than 0.1 Fe;
less than 0.1 Cu;
less than 0.01 Ni; and,
Mg: balance.

The magnesium alloy can consist essentially of, in weight percent, Al: 4.5-6.5; Zn: 0.1-3.0; Ca: 0-1.5; Sn: 0-4.0; Mn: 0.1-0.5; Si: 0-0.5; B+Sr: 0-0.5; less than 0.1 Fe; less than 0.1 Cu; less than 0.01 Ni; and Mg: balance. The magnesium alloy can consist of, in weight percent, Al: 4.5-6.5; Zn: 0.1-3.0; Ca: 0-1.5; Sn: 0-4.0; Mn: 0.1-0.5; Si: 0-0.5; B+Sr: 0-0.5; less than 0.1 Fe; less than 0.1 Cu; less than 0.01 Ni; and Mg: balance.

The Al in weight percent can be from 4.5 to 6.5 wt. %. The Al in weight percent can be 4.5, 4.6, 4.7, 4.8, 4.9, 5.0, 5.1, 5.2, 5.3, 5.4, 5.5, 5.6, 5.7, 5.8, 5.9, 6.0, 6.1, 6.2, 6.3, 6.4, or 6.5 wt. % Al. The weight % Al can be within a range of any high value and low value selected from these values.

The Zn in weight percent can be from 0.1-3.0 wt. %. The Zn in weight percent can be 0.10, 0.11, 0.12, 0.13, 0.14, 0.15, 0.16, 0.17, 0.18, 0.19, 0.2, 0.3, 0.4, 0.5, 0.6, 0.7, 0.8, 0.9, 1.0, 1.1, 1.2, 1.3, 1.4, 1.5, 1.6, 1.7, 1.8, 1.9, 2.0, 2.1, 2.2, 2.3, 2.4, 2.5, 2.6, 2.7, 2.8, 2.9 or 3.0 wt % Zn. The weight % Zn can be within a range of any high value and low value selected from these values.

The Ca in weight percent can be from 0-1.5 wt. %. The Ca in weight percent can be 0, 0.01, 0.02, 0.03, 0.04, 0.05, 0.06, 0.07, 0.08, 0.09, 0.1, 0.2, 0.3, 0.4, 0.5, 0.6, 0.7, 0.8, 0.9, 1.0, 1.1, 1.2, 1.3, 1.4, or 1.5 wt % Ca. The weight % Ca can be within a range of any high value and low value selected from these values.

The Sn in weight percent can be from 0-4.0 wt. %. The Sn in weight percent can be 0, 0.25, 0.5, 0.75, 1.0, 1.25, 1.5, 1.75, 2.0, 2.25, 2.5, 2.75, 3.0, 3.25, 3.5, 3.75 or 4.0 wt % Sn. The weight % Sn can be within a range of any high value and low value selected from these values.

The Mn in weight percent can be from 0.1-0.5 wt. %. The Mn in weight percent can be 0.1, 0.15, 0.2, 0.25, 0.3, 0.35, 0.4, 0.45 or 0.5 wt. % Mn. The weight % Mn can be within a range of any high value and low value selected from these values.

The Si in weight percent can be from 0-0.5 wt. %. The Si weight percent can be 0, 0.05, 0.1, 0.15, 0.2, 0.25, 0.3, 0.35, 0.4, 0.45, or 0.5 wt. % Si. The weight % Si can be within a range of any high value and low value selected from these values.

The B+Sr in weight percent can be from 0-0.5 wt. %. The B weight percent can be 0, 0.01, 0.02, 0.03, 0.04, 0.05, 0.06 0.07, 0.08, 0.09, 0.10, 0.12, 0.15, 0.17, 0.20, 0.22, 0.25, 0.27, 0.30, 0.32, 0.35, 0.37, 0.40, 0.42, 0.45, 0.47, or 0.50 wt. % B+Sr. The weight % B+Sr can be within a range of any high value and low value selected from these values.

The alloy can have Fe less than 0.1 wt. % Fe. The alloy can have 0, 0.0001, 0.0002, 0003, 0.0004, 0.0005, 0.0006, 0.0007, 0.0008, 0.0009, 0.001, 0.002, 0.003, 0.004, 0.005, 0.006, 0.007, 0.008, 0.009, 0.01, 0.0125, 0.015, 0.0175, 0.02, 0.03, 0.04, 0.05, 0.06, 0.07, 0.08, 0.09 or 0.1 wt. % Fe. The weight % Fe can be within a range of any high value and low value selected from these values.

The alloy can have less than 0.1 wt. % Cu; The alloy can have 0, 0.0001, 0.0002, 0003, 0.0004, 0.0005, 0.0006, 0.0007, 0.0008, 0.0009, 0.001, 0.002, 0.003, 0.004, 0.005, 0.006, 0.007, 0.008, 0.009, 0.01, 0.0125, 0.015, 0.0175, 0.02, 0.03, 0.04, 0.05, 0.06, 0.07, 0.08, 0.09 or 0.1 wt. % Cu. The weight % Cu can be within a range of any high value and low value selected from these values.

The alloy can have less than 0.01 wt. % Ni. The wt. % Ni can be 0, 0.0001, 0.0002, 0003, 0.0004, 0.0005, 0.0006, 0.0007, 0.0008, 0.0009, 0.001, 0.002, 0.003, 0.004, 0.005, 0.006, 0.007, 0.008, 0.009, or 0.01 wt. % Ni. The weight % Ni can be within a range of any high value and low value selected from these values.

The alloy can have Ge in weight percent can be from 0-0.5 wt. % Ge. The Ge weight percent can be 0, 0.001, 0.002, 0.003, 0.004, 0.005, 0.006, 0.007, 0.008, 0.009, 0.01, 0.02, 0.03, 0.04, 0.05, 0.06 0.07, 0.08, 0.09, 0.10, 0.12, 0.15, 0.17, 0.20, 0.22, 0.25, 0.27, 0.30, 0.32, 0.35, 0.37, 0.40, 0.42, 0.45, 0.47, or 0.50 wt. % Ge. The weight % Ge can be within a range of any high value and low value selected from these values.

The alloy can have Li in weight percent can be from 0-0.5 wt. % Li. The Li weight percent can be 0, 0.001, 0.002, 0.003, 0.004, 0.005, 0.006, 0.007, 0.008, 0.009, 0.01, 0.02, 0.03, 0.04, 0.05, 0.06 0.07, 0.08, 0.09, 0.10, 0.12, 0.15, 0.17, 0.20, 0.22, 0.25, 0.27, 0.30, 0.32, 0.35, 0.37, 0.40, 0.42, 0.45, 0.47, or 0.50 wt. % Li. The weight % Li can be within a range of any high value and low value selected from these values.

In another aspect, the magnesium alloys described herein are used in thixomolding applications. A method of preparing a thixomolded article can include the step of providing a magnesium alloy comprising, in weight percent Al: 4.5-6.5; Zn: 0.1-3.0; Ca: 0-1.5; Sn: 0-4.0; Mn: 0.1-0.5; Si: 0-0.5; B+Sr: 0-0.5; less than 0.1 Fe; less than 0.1 Cu; less than 0.01 Ni; and Mg: balance. The magnesium alloy is heated to a temperature of 500-600° C. (a temperature between the liquidus and solidus), producing a thixotropic alloy comprising 30-65 weight % solids. The thixotropic alloy is transported into a mold. The thixotropic alloy is then allowed to cool to produce a solid thixomolded article.

Articles made from the magnesium alloys of the invention are designed to be used in the as-cast condition. They can be cast with typical procedures for magnesium alloys to protect them from oxidation. A thixomolded article can comprise a magnesium alloy comprising, in weight percent Al: 4.5-6.5; Zn: 0.1-3.0; Ca: 0-1.5; Sn: 0-4.0; Mn: 0.1-0.5; Si: 0-0.5; B+Sr: 0-0.5; less than 0.1 Fe; less than 0.1 Cu; less than 0.01 Ni; and Mg: balance. The article can have a weight of at least 3.6 kg. The thixomolded article can have a largest dimension of at least 50 cm.

Figure 2:
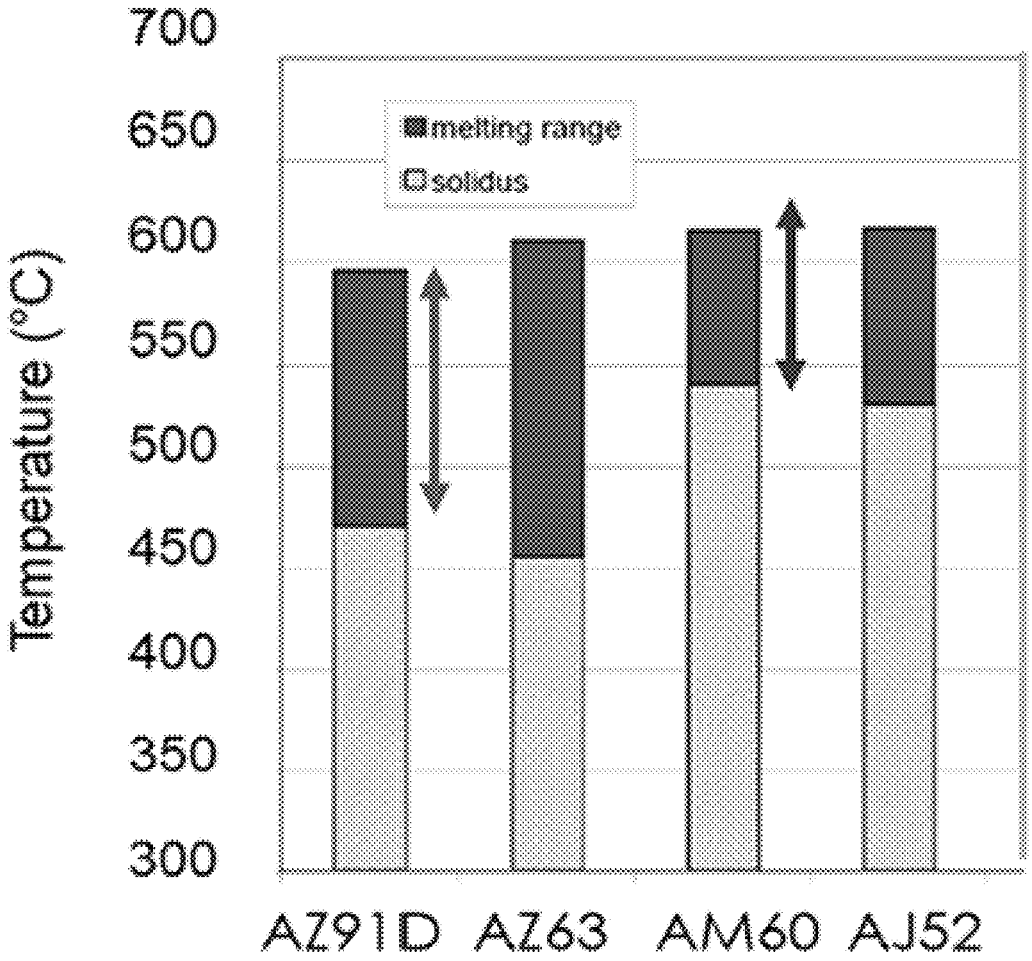
FIG. 2 is a plot of strength, solidus and melting range for AZ91D and AM60.
Figure 3:
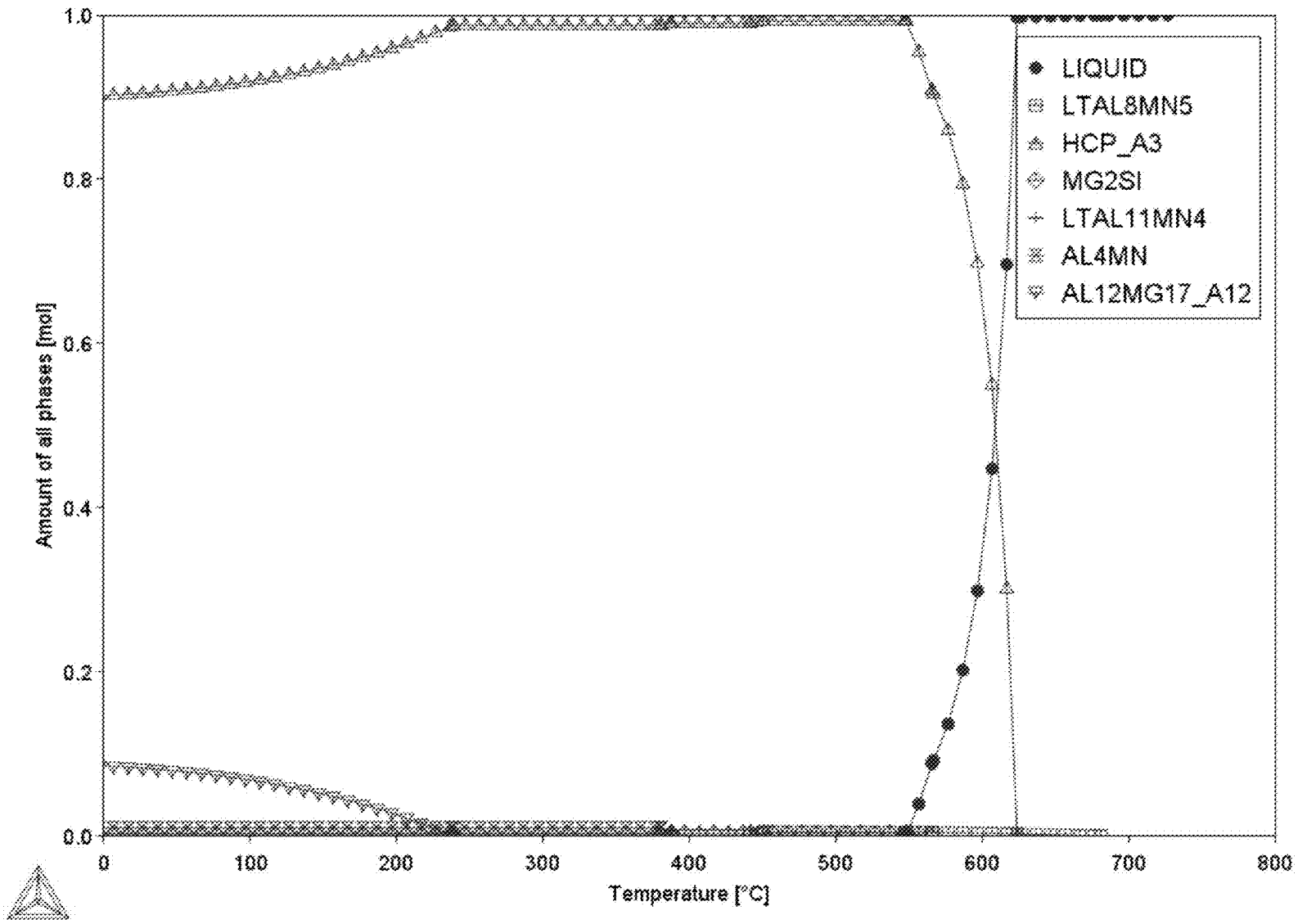
FIG. 3 shows the calculated equilibrium phase diagram for alloy AM50.
Figure 4:
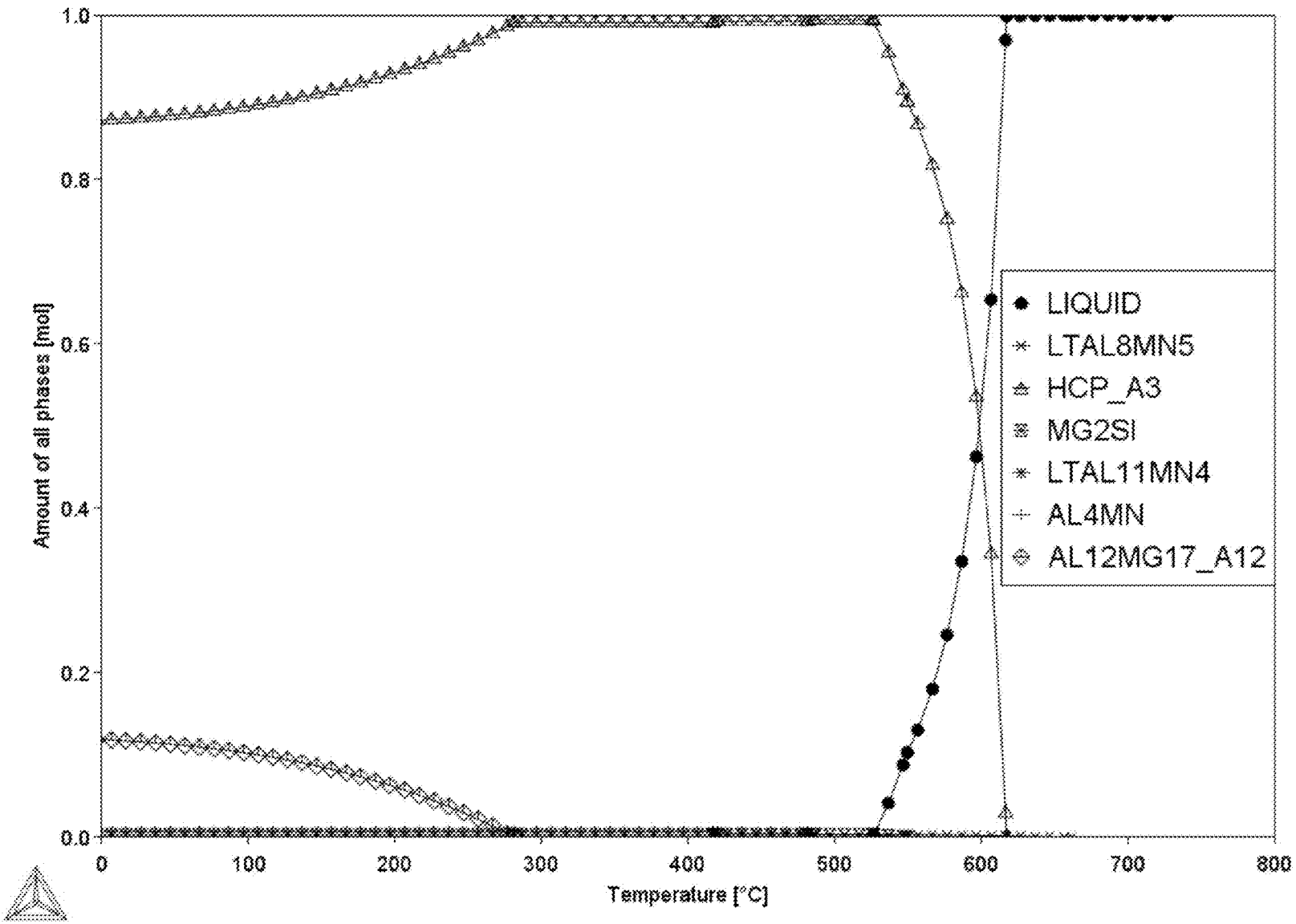
FIG. 4 shows the calculated equilibrium phase diagram for alloy AM60B.
Figure 5:
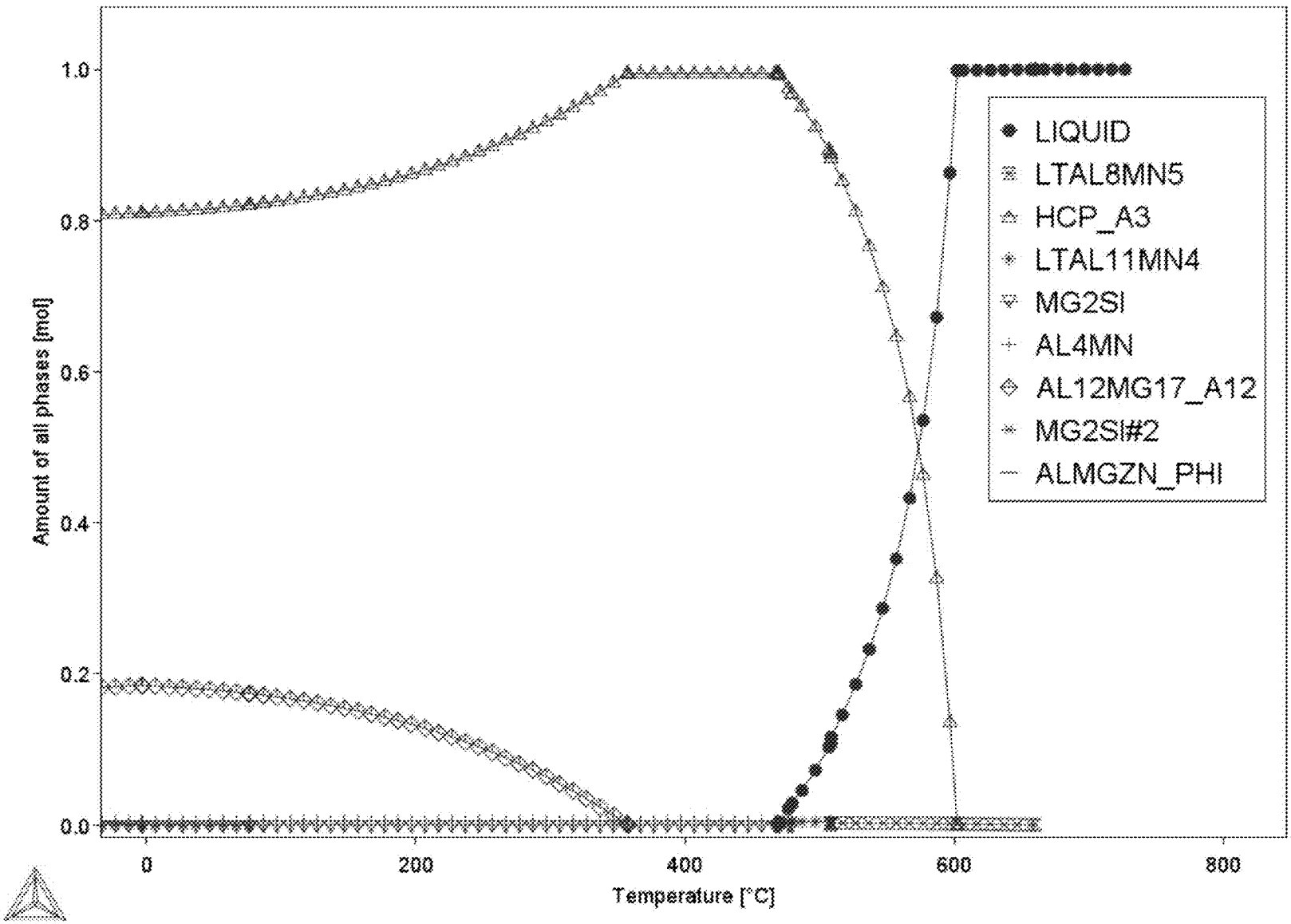
FIG. 5 shows the calculated equilibrium phase diagram for alloy AZ91D.
Figure 6:
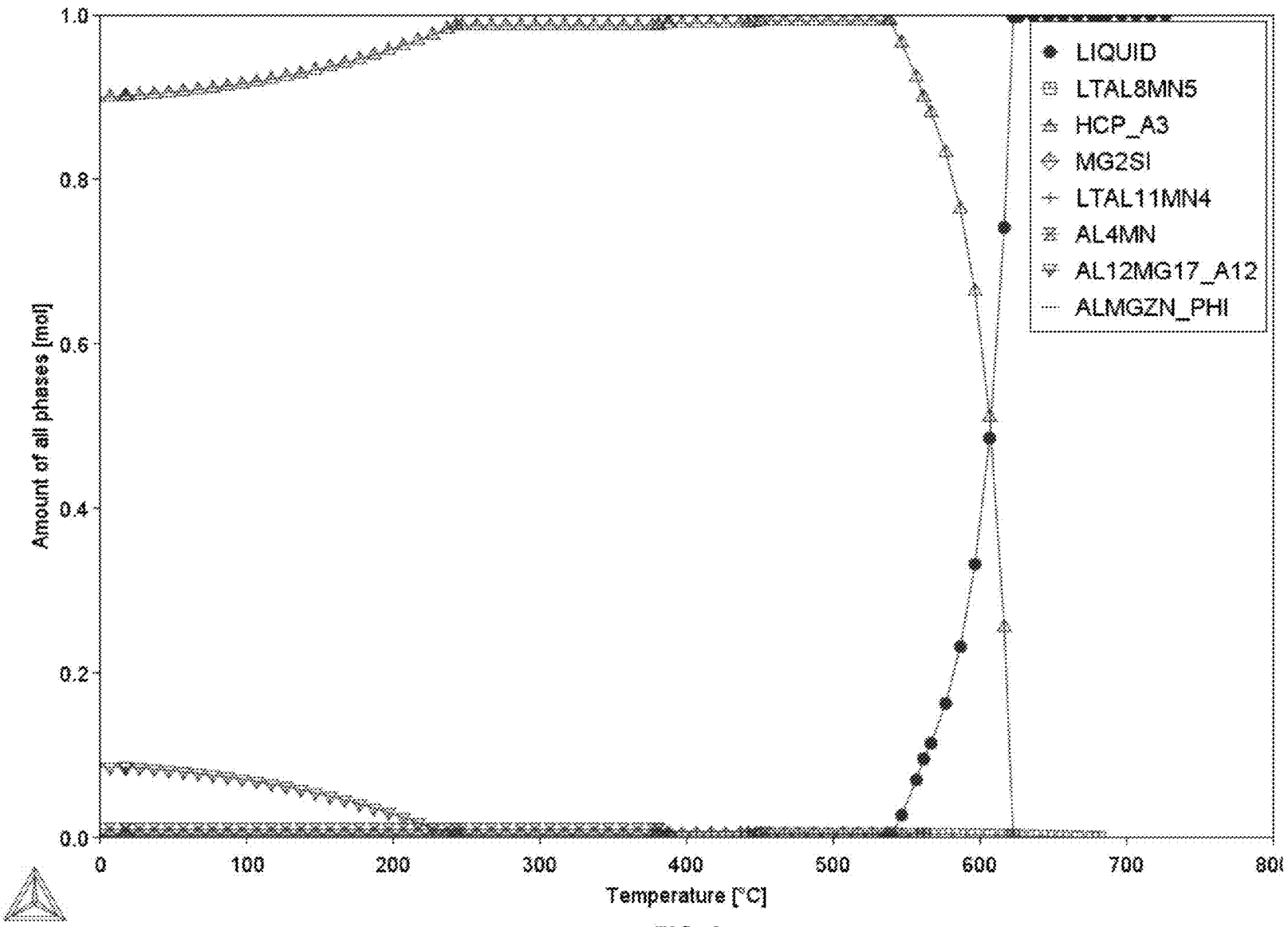
FIG. 6 shows the calculated equilibrium phase diagram for alloy A511.
Figure 7:
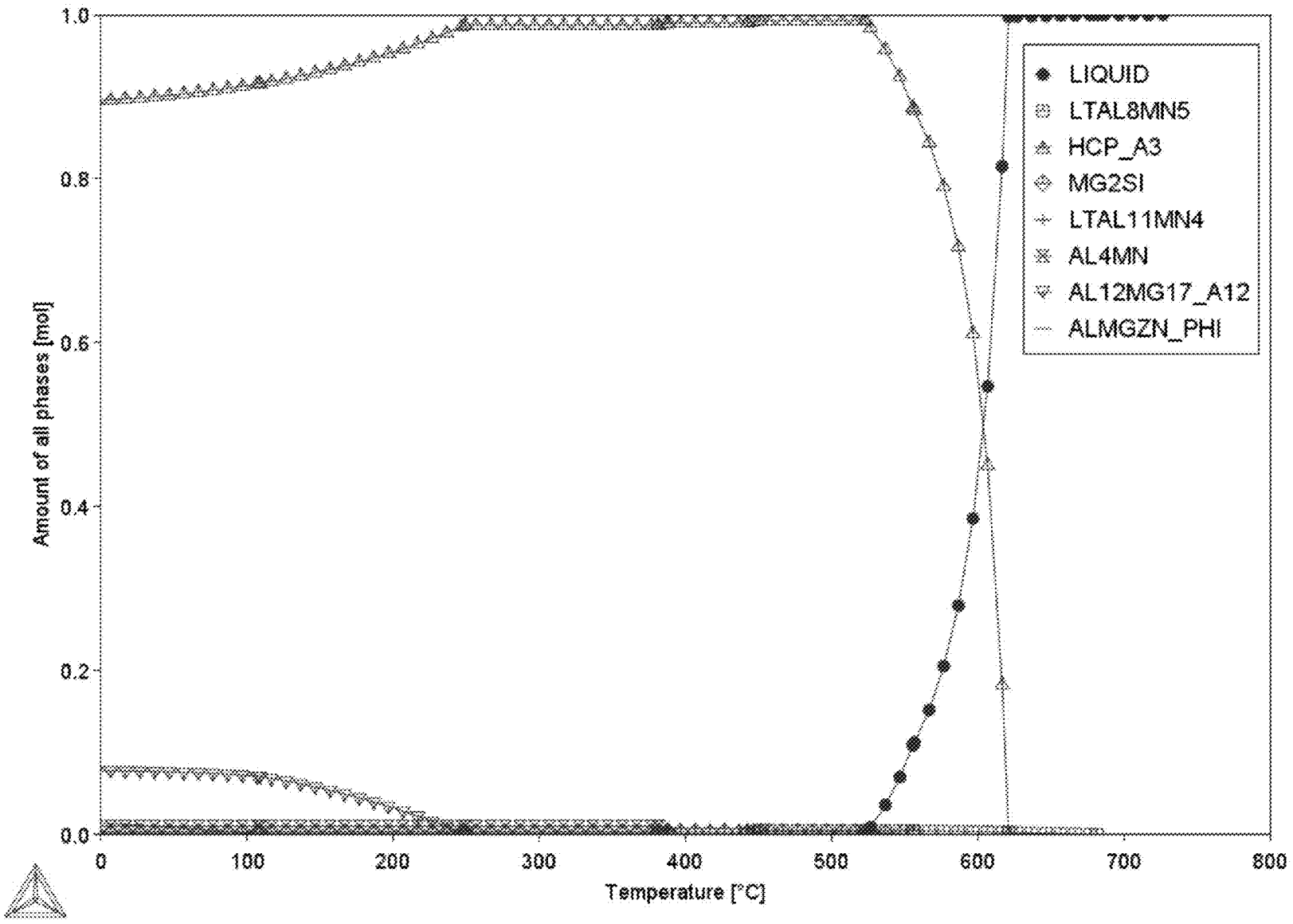
FIG. 7 shows the calculated equilibrium phase diagram for alloy A512.
Figure 8:
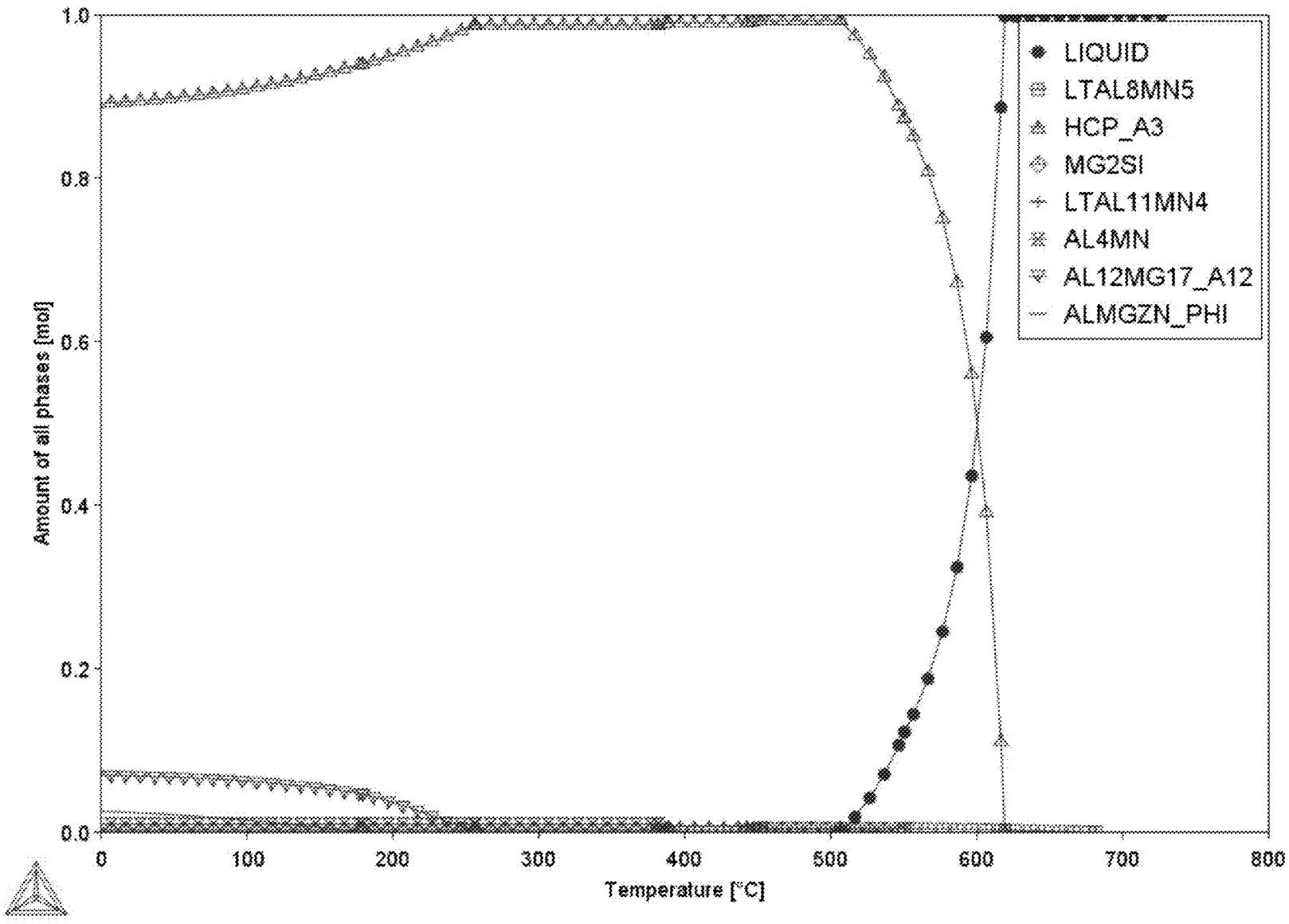
FIG. 8 shows the calculated equilibrium phase diagram for alloy A513.
Figure 9:
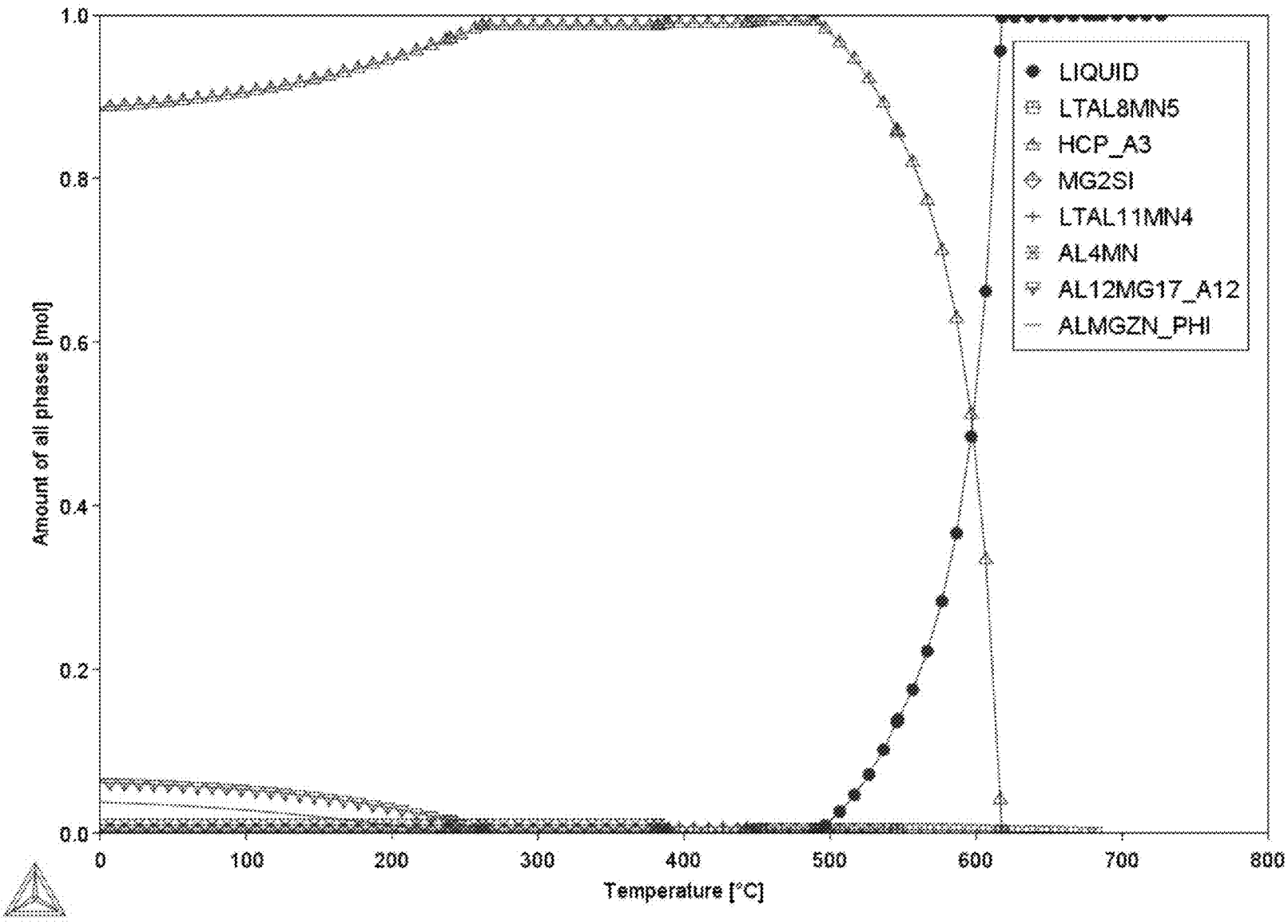
FIG. 9 shows the calculated equilibrium phase diagram for alloy A514.
Figure 10:
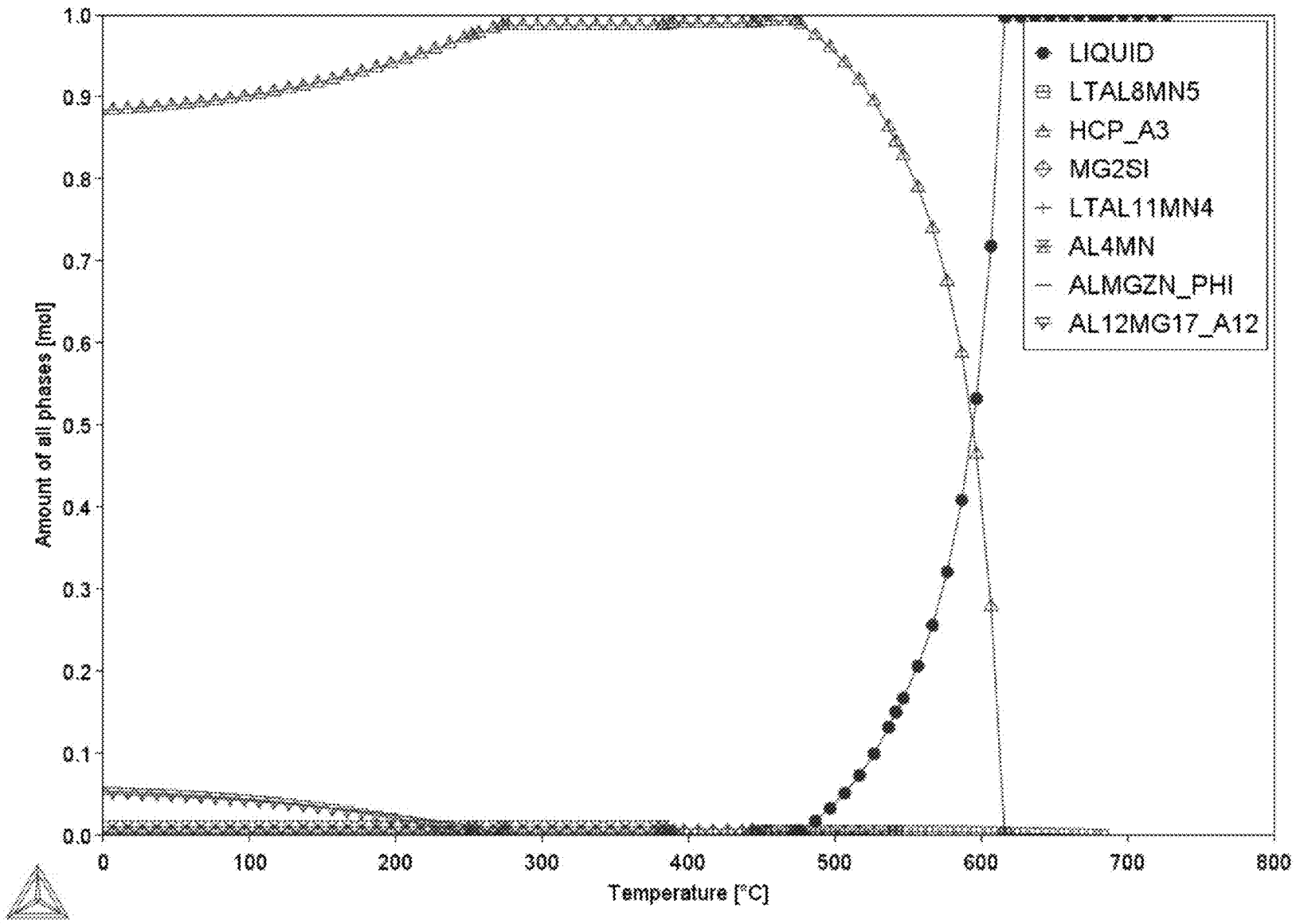
FIG. 10 shows the calculated equilibrium phase diagram for alloy A515.
Figure 11:
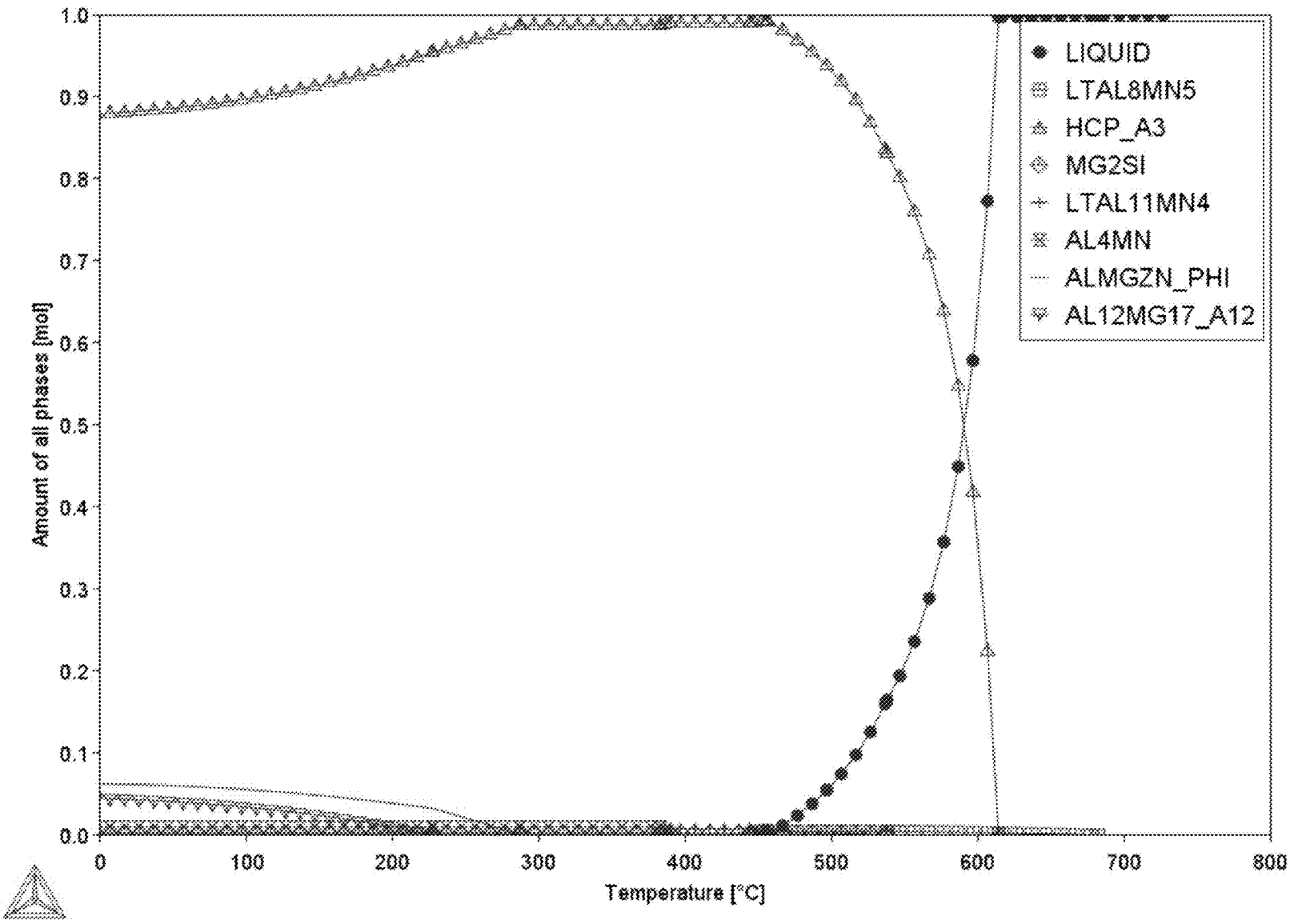
FIG. 11 shows the calculated equilibrium phase diagram for alloy A516.
Figure 12:
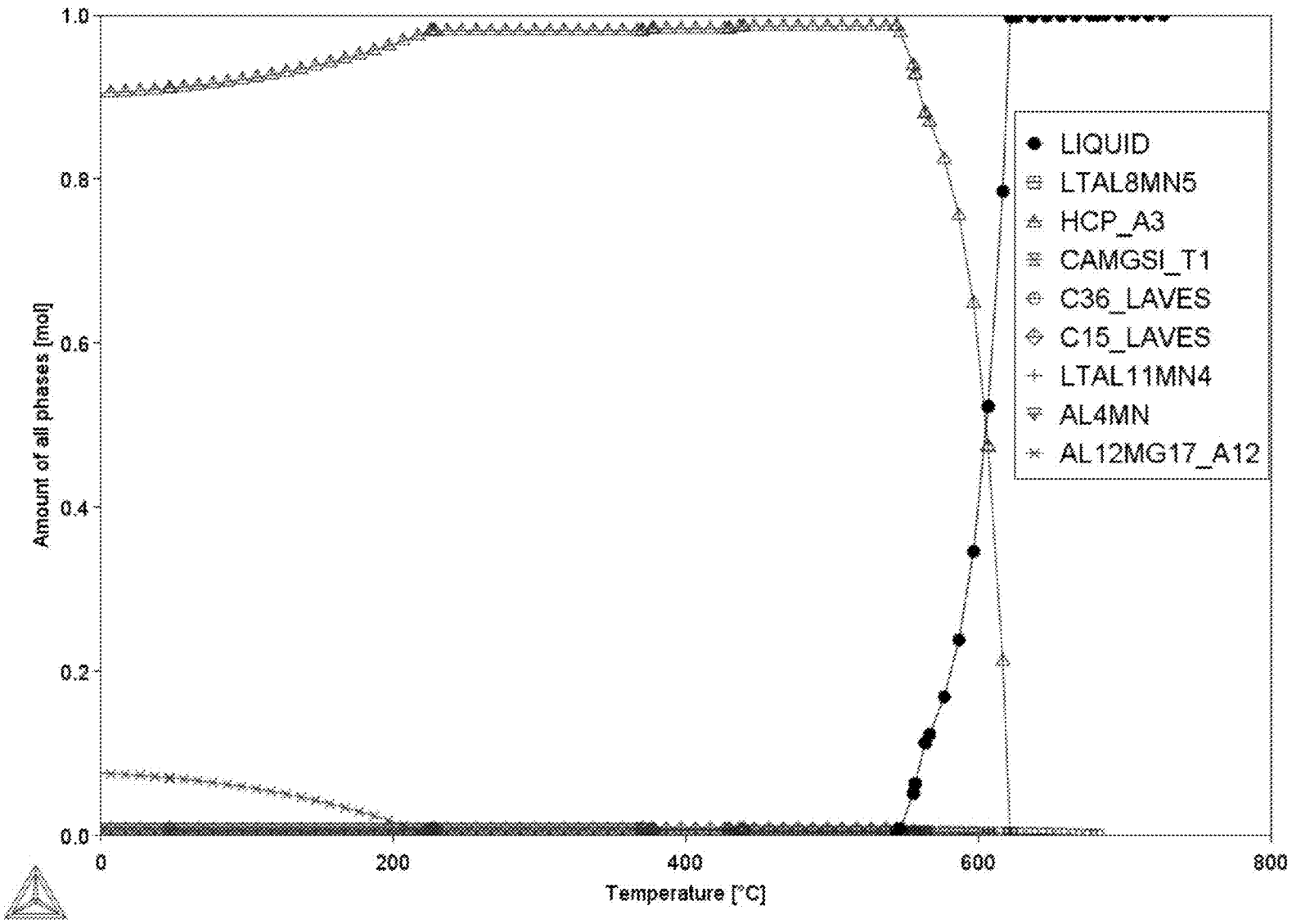
FIG. 12 shows the calculated equilibrium phase diagram for alloy A521.
Figure 13:
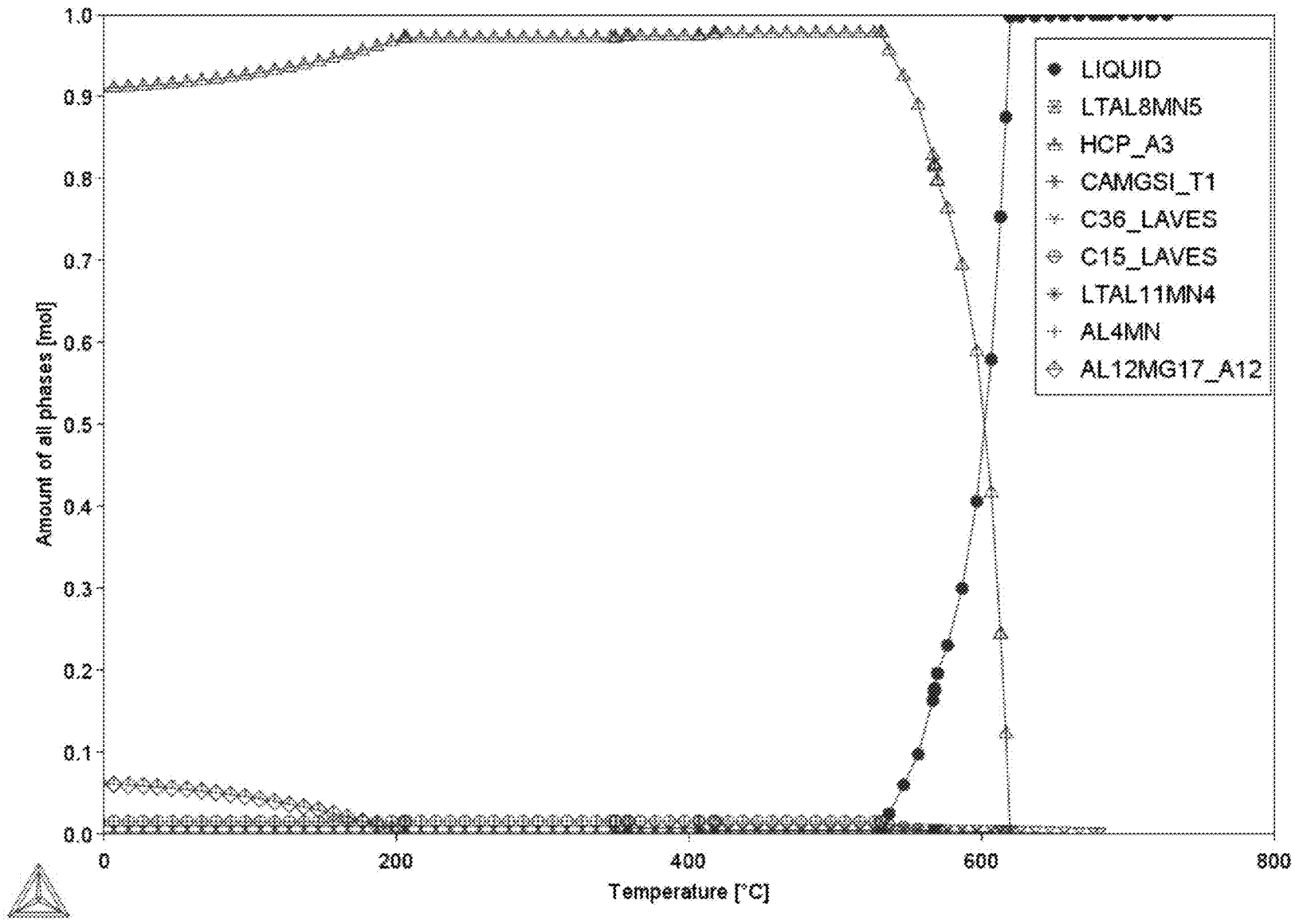
FIG. 13 shows the calculated equilibrium phase diagram for alloy A522.
Figure 14:
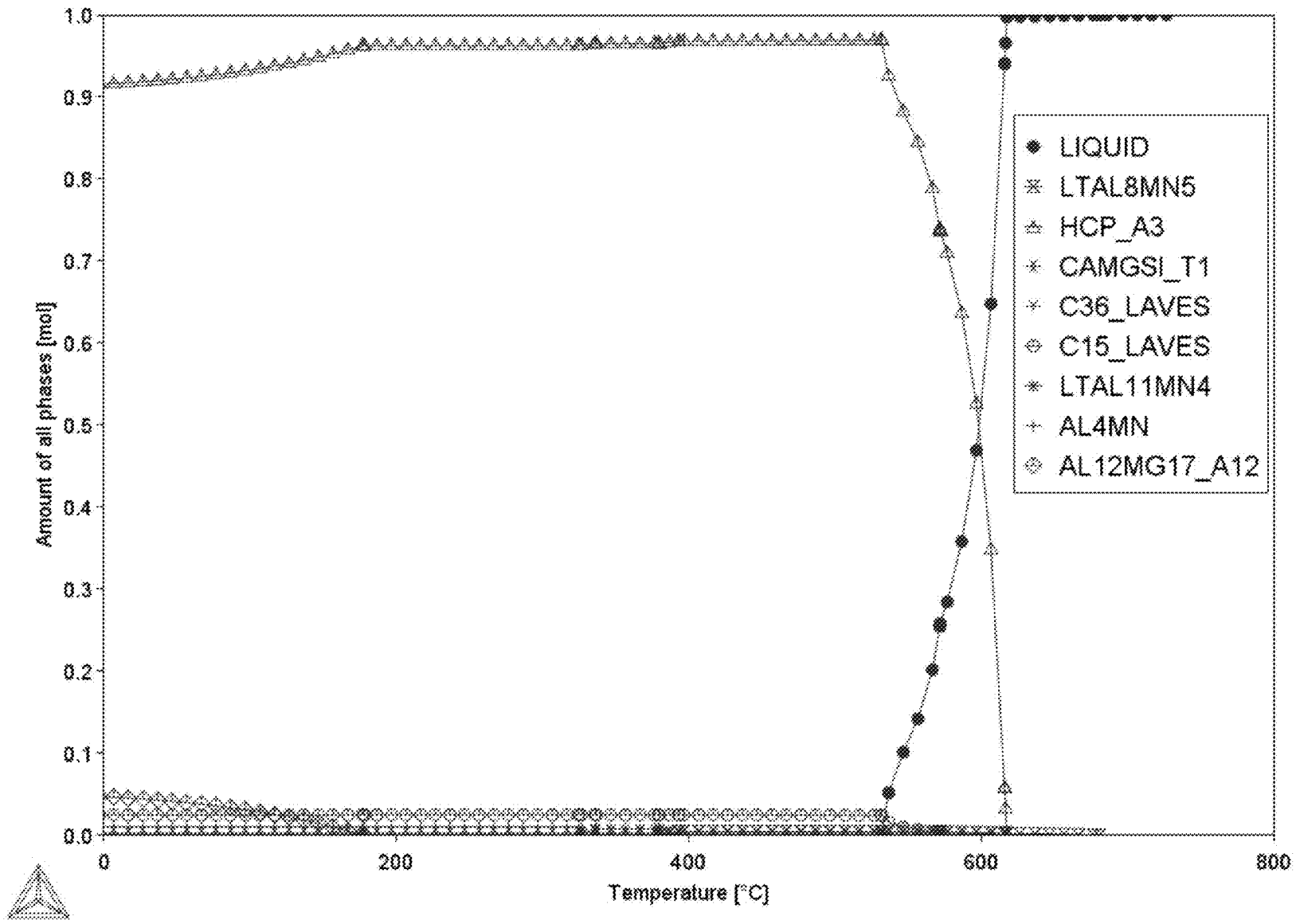
FIG. 14 shows the calculated equilibrium phase diagram for alloy A523.
Figure 15:
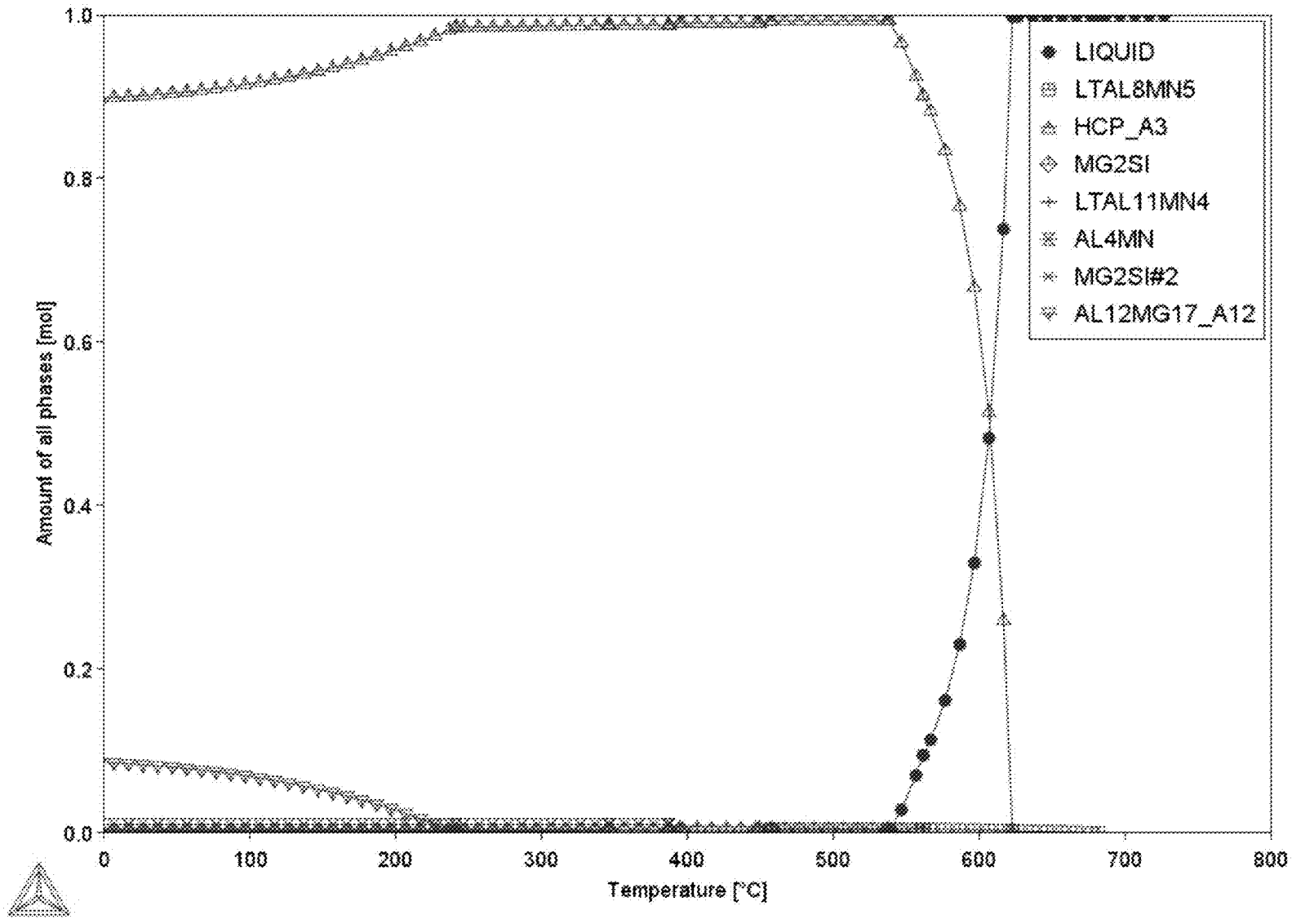
FIG. 15 shows the calculated equilibrium phase diagram for alloy A531.
Figure 16:
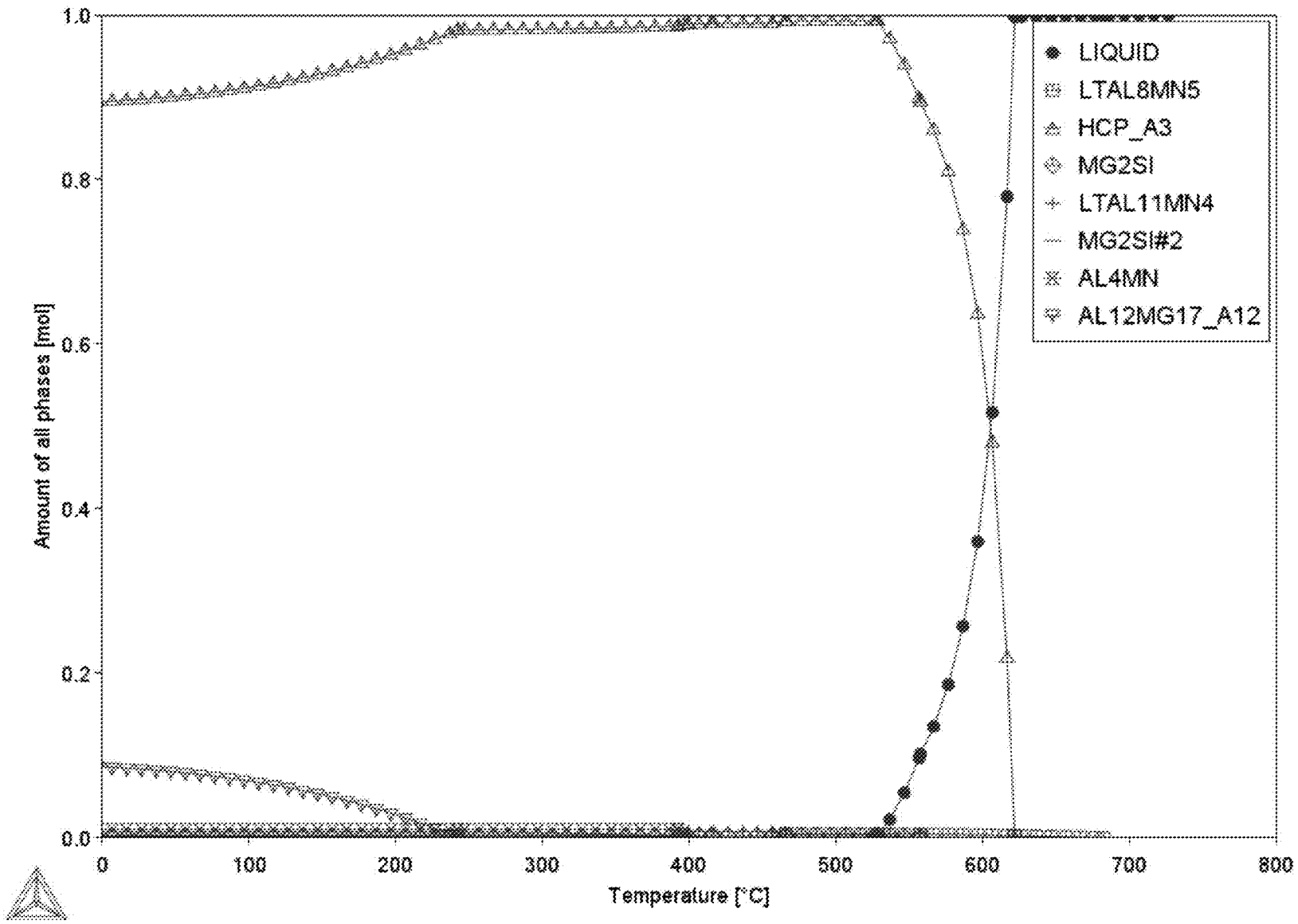
FIG. 16 shows the calculated equilibrium phase diagram for alloy A532.
Figure 17:
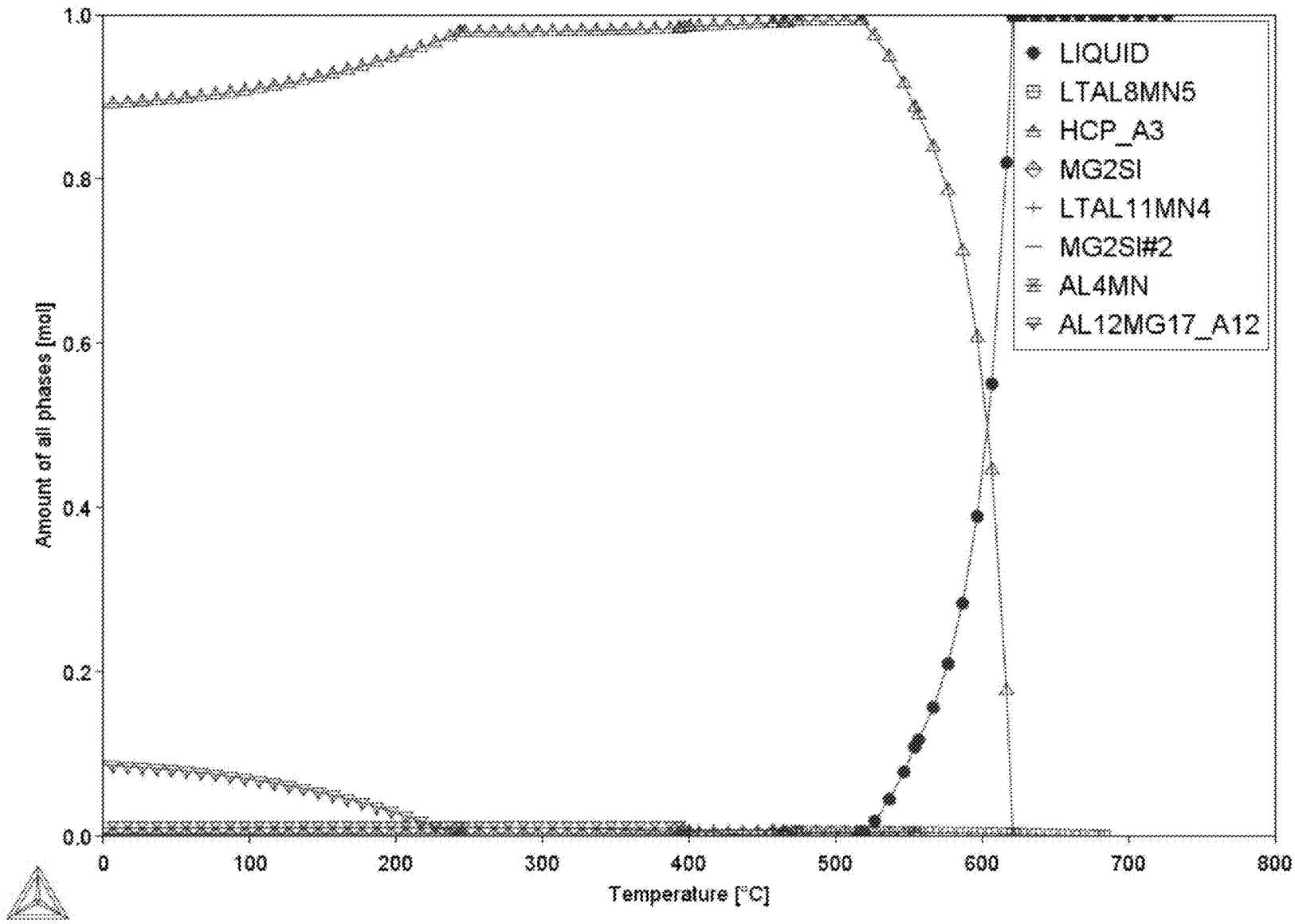
FIG. 17 shows the calculated equilibrium phase diagram for alloy A533.
Figure 18:
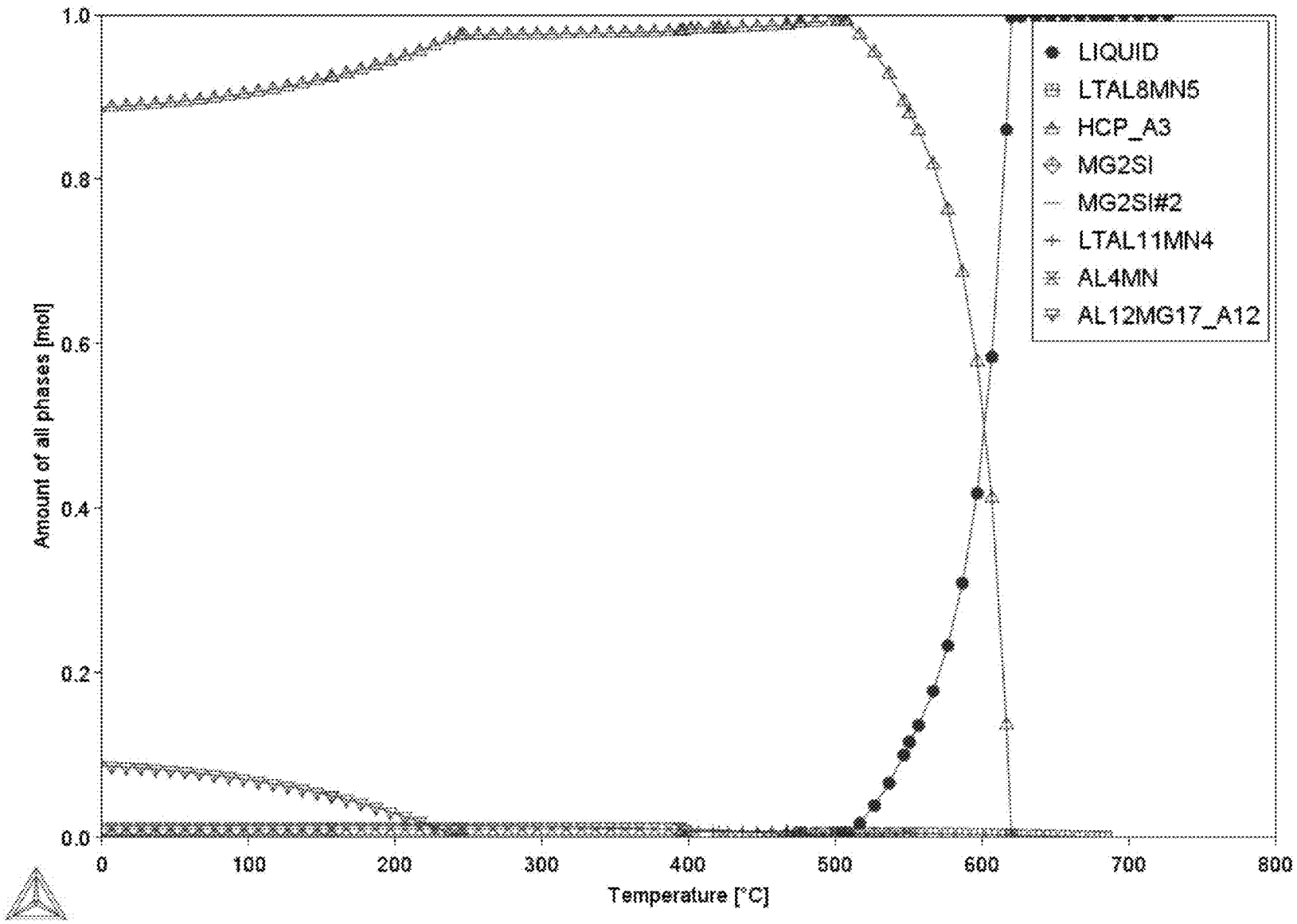
FIG. 18 shows the calculated equilibrium phase diagram for alloy A534.
Figure 19:
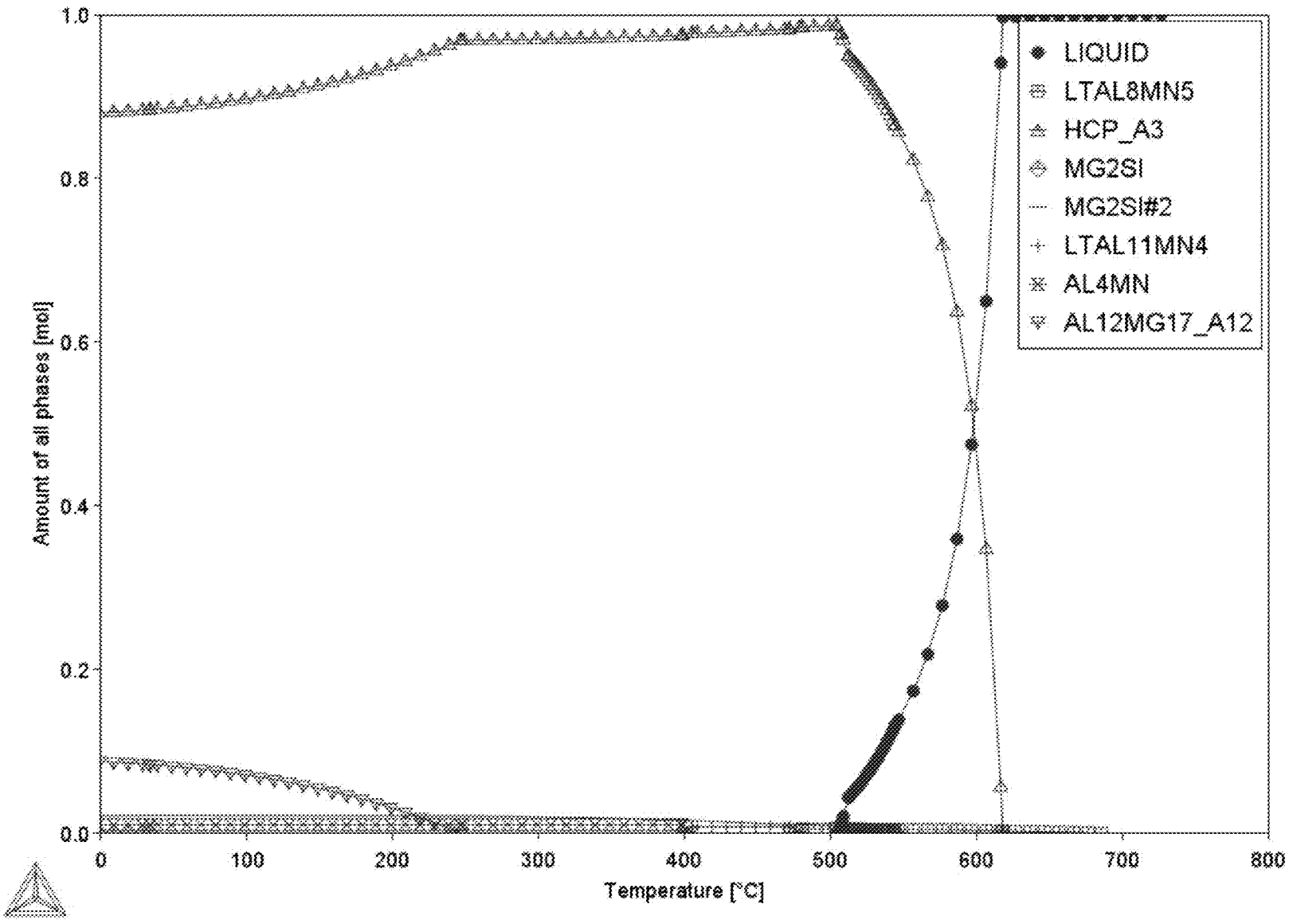
FIG. 19 shows the calculated equilibrium phase diagram for alloy A535.
Figure 20:
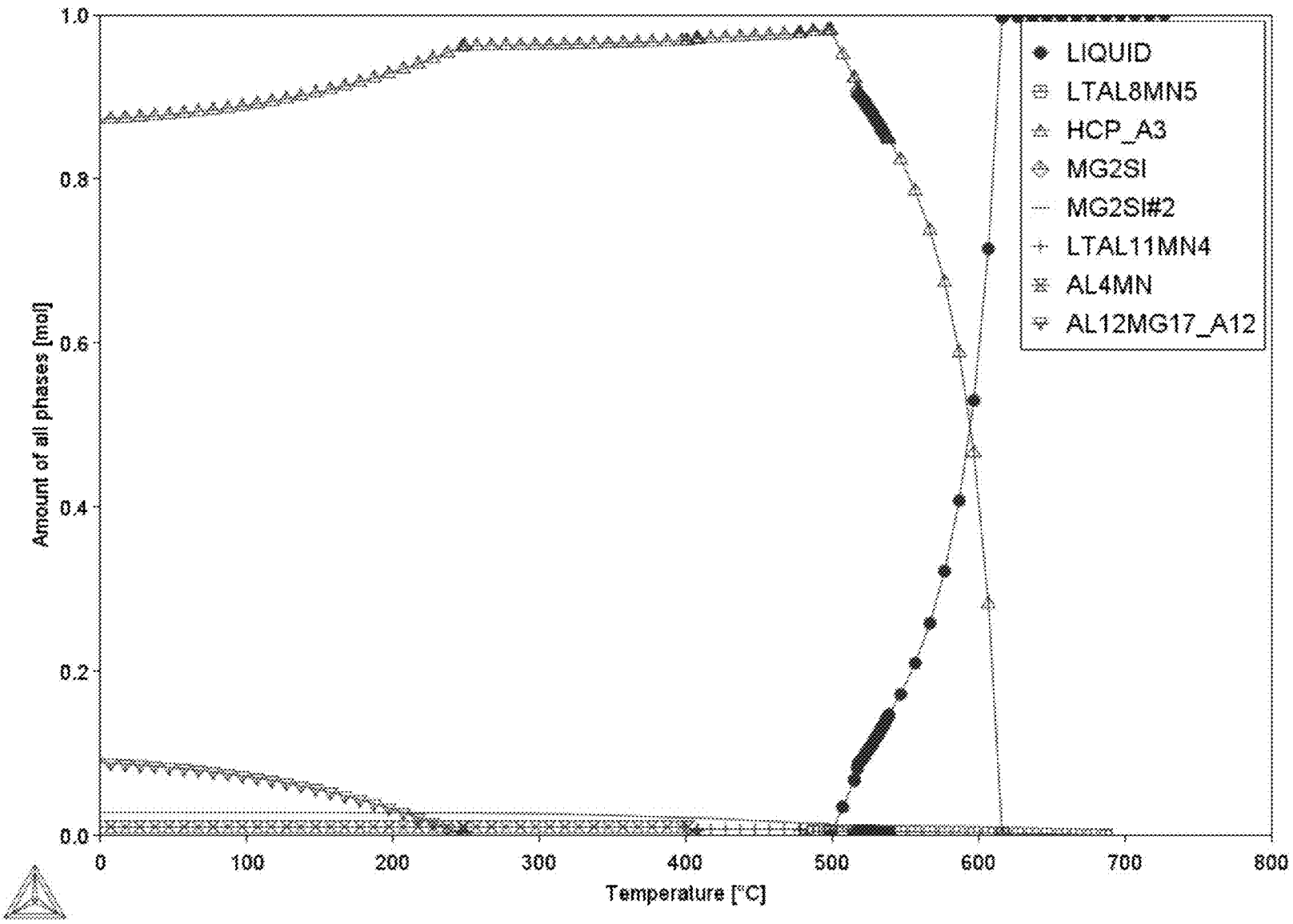
FIG. 20 shows the calculated equilibrium phase diagram for alloy A536.
Figure 21:
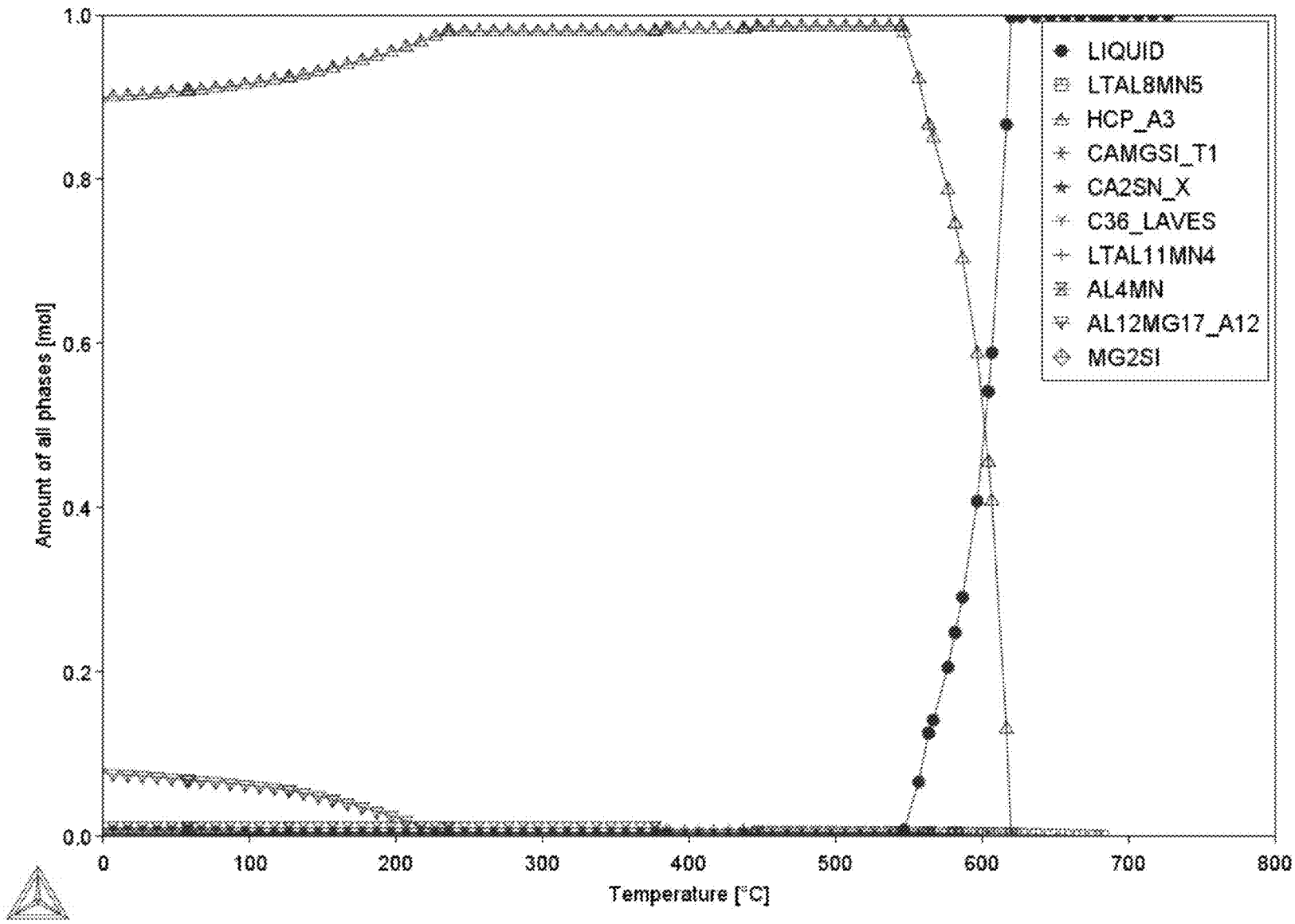
FIG. 21 shows the calculated equilibrium phase diagram for alloy A541.
Figure 22:
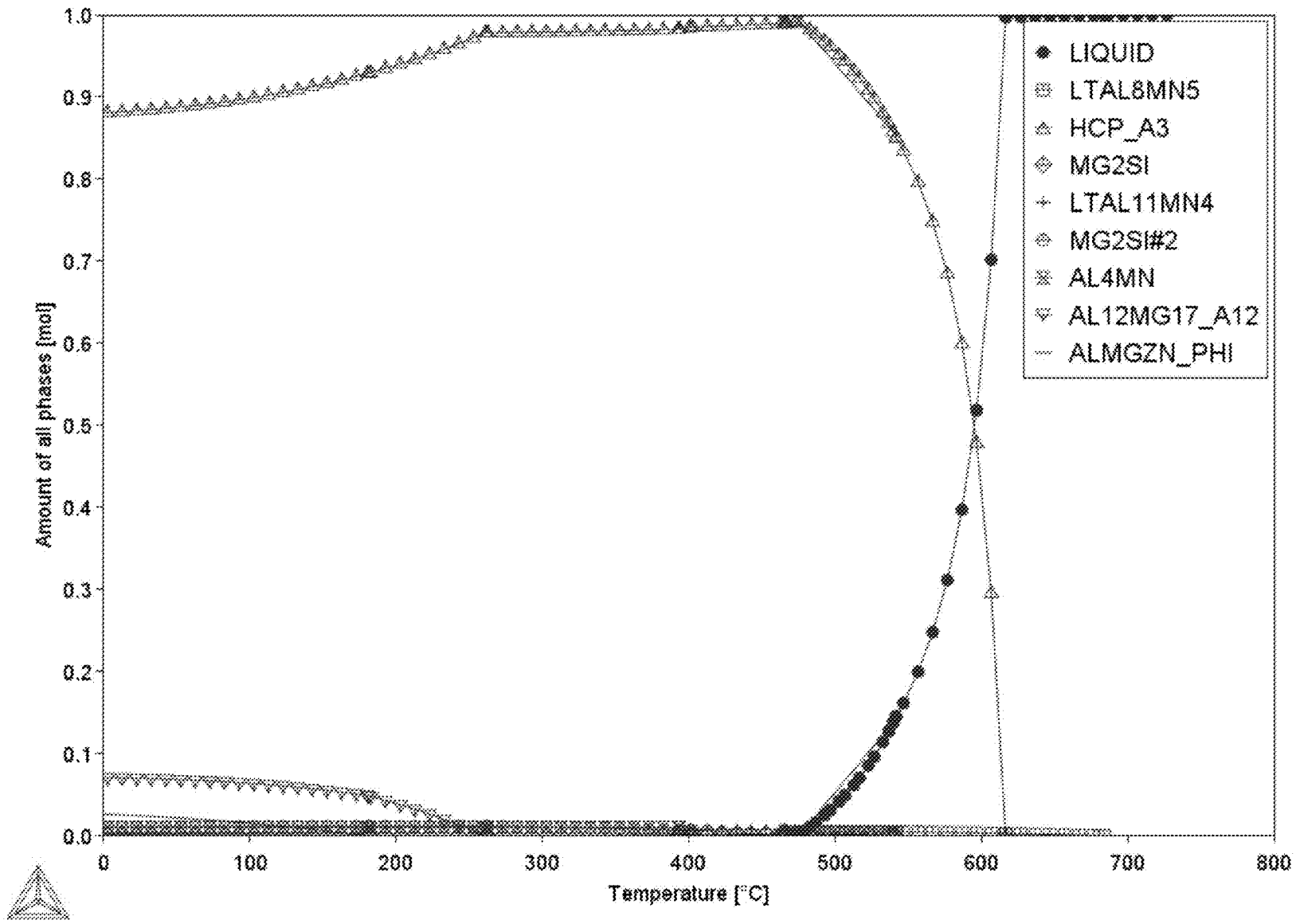
FIG. 22 shows the calculated equilibrium phase diagram for alloy A542.
Figure 23:
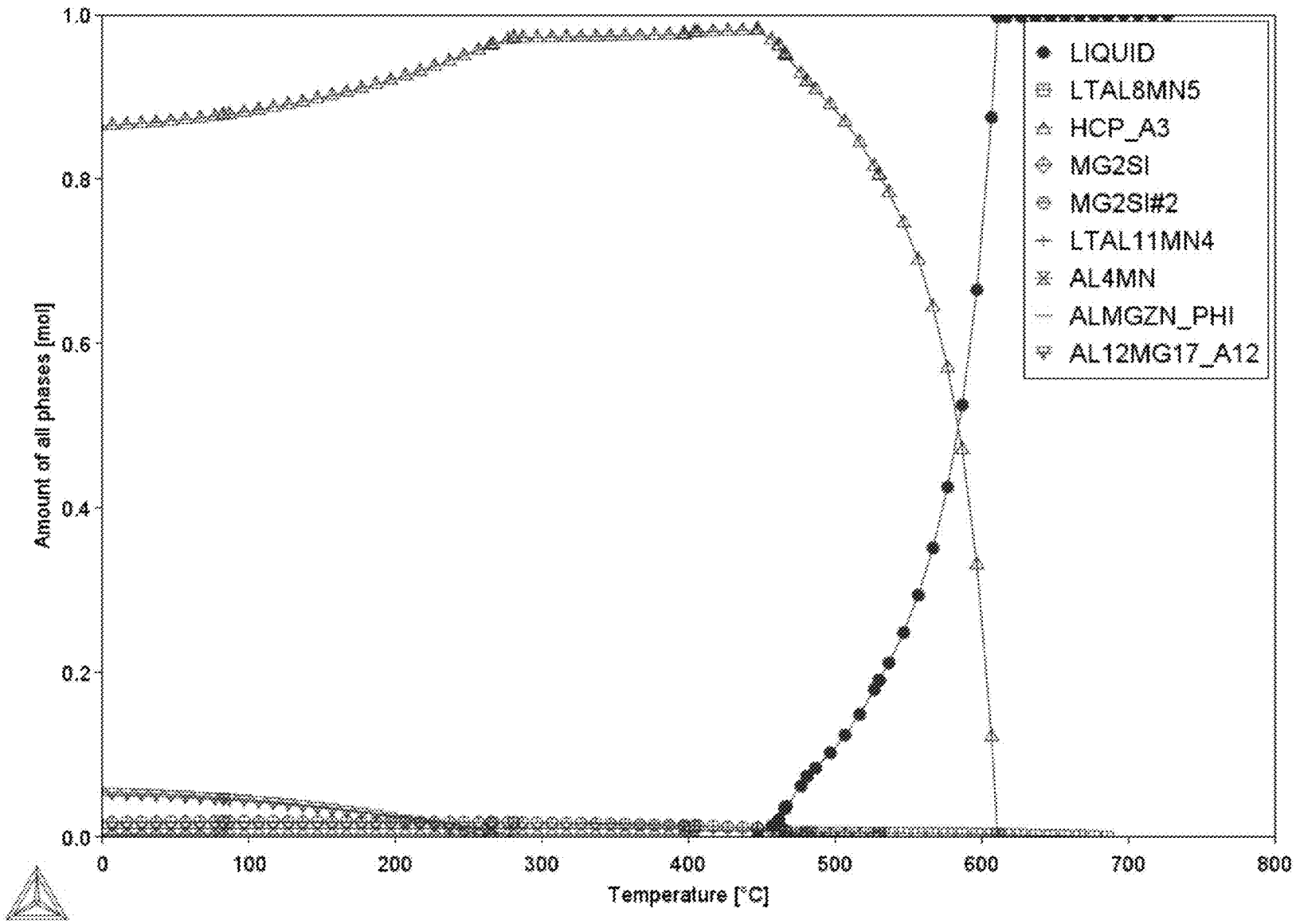
FIG. 23 shows the calculated equilibrium phase diagram for alloy A543.
Figure 24:
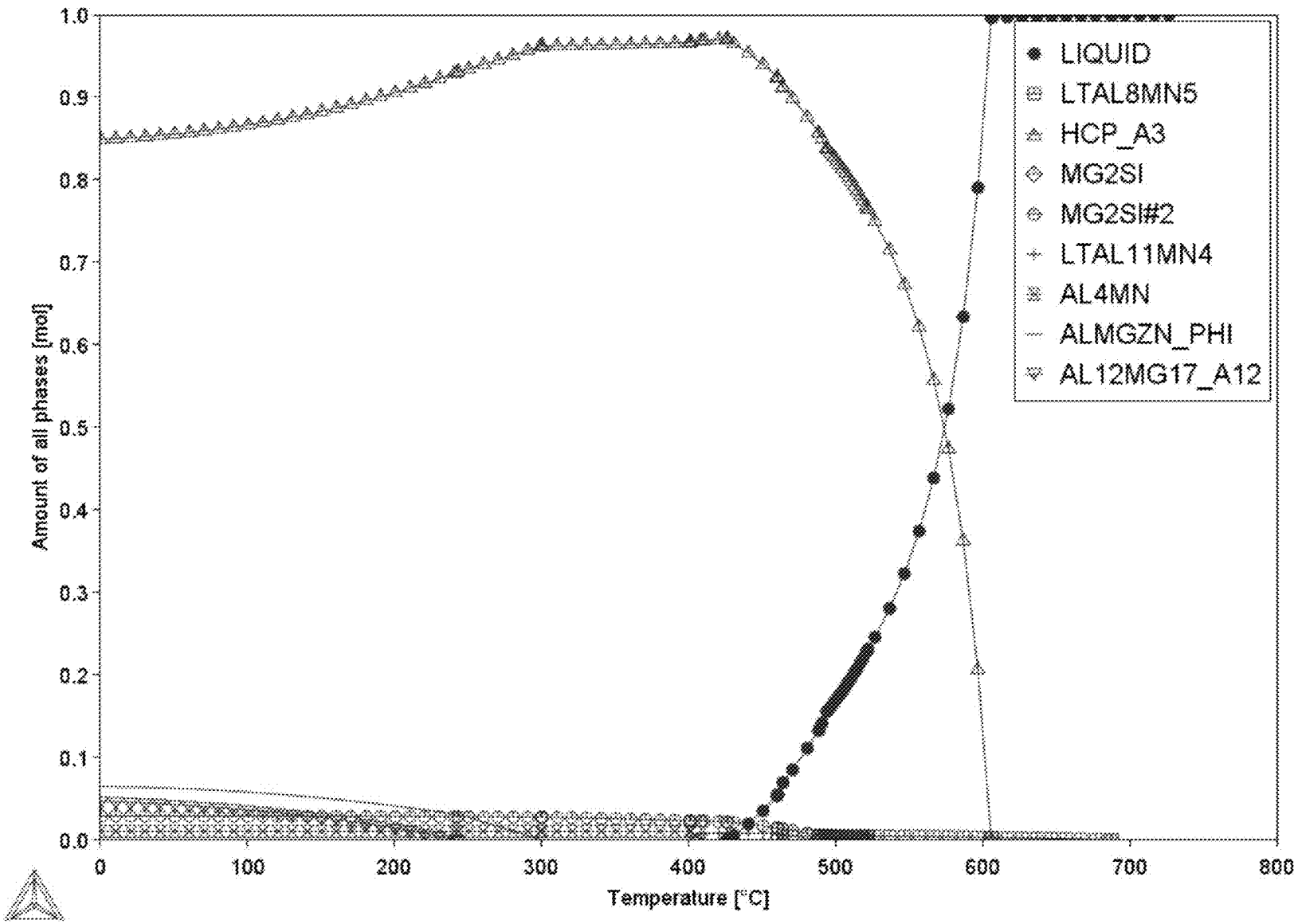
FIG. 24 shows the calculated equilibrium phase diagram for alloy A544.
Figure 25:
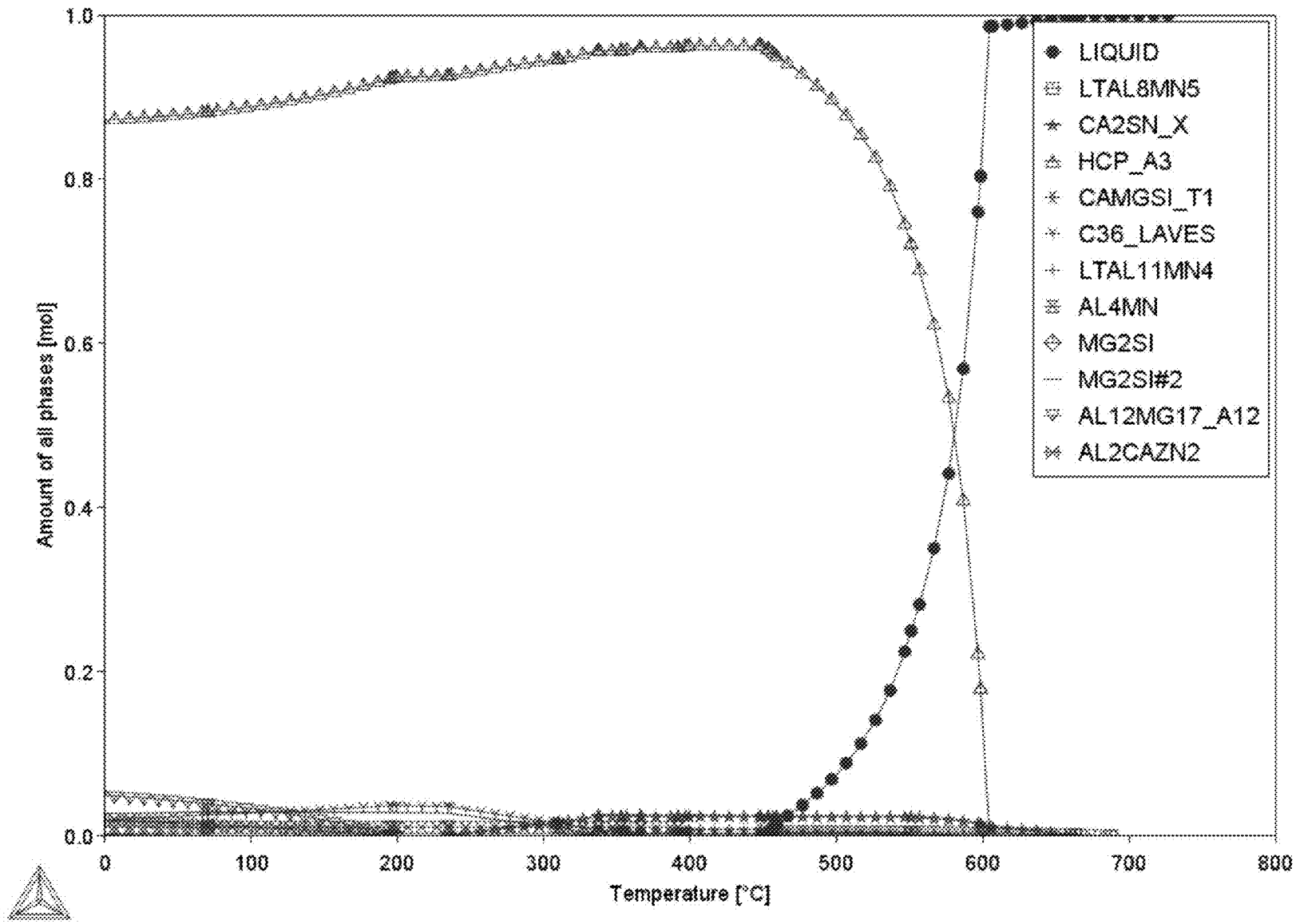
FIG. 25 shows the calculated equilibrium phase diagram for alloy A545.
Figure 26:
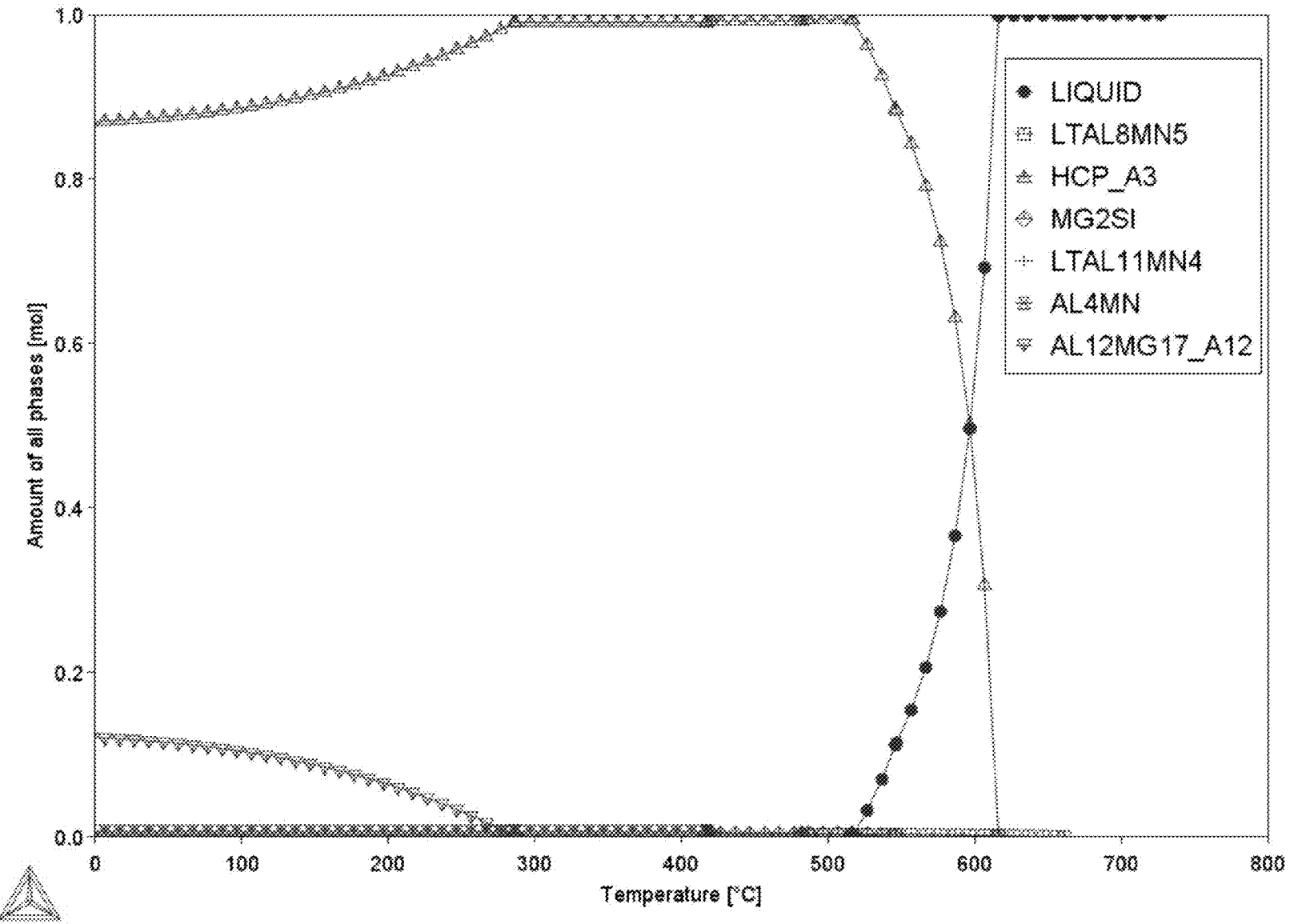
FIG. 26 shows the calculated equilibrium phase diagram for alloy A611.
Figure 27:
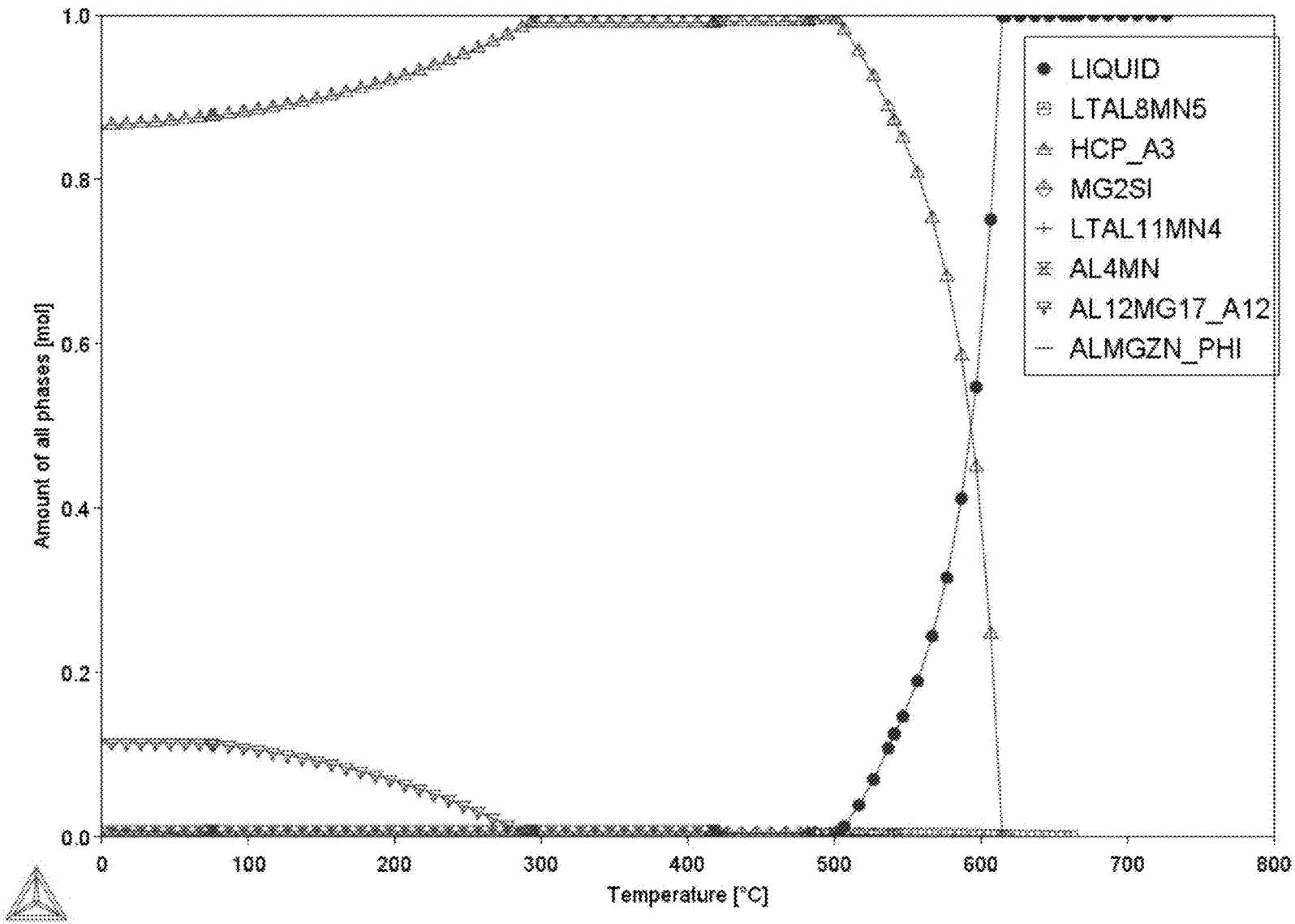
FIG. 27 shows the calculated equilibrium phase diagram for alloy A612.
Figure 28:
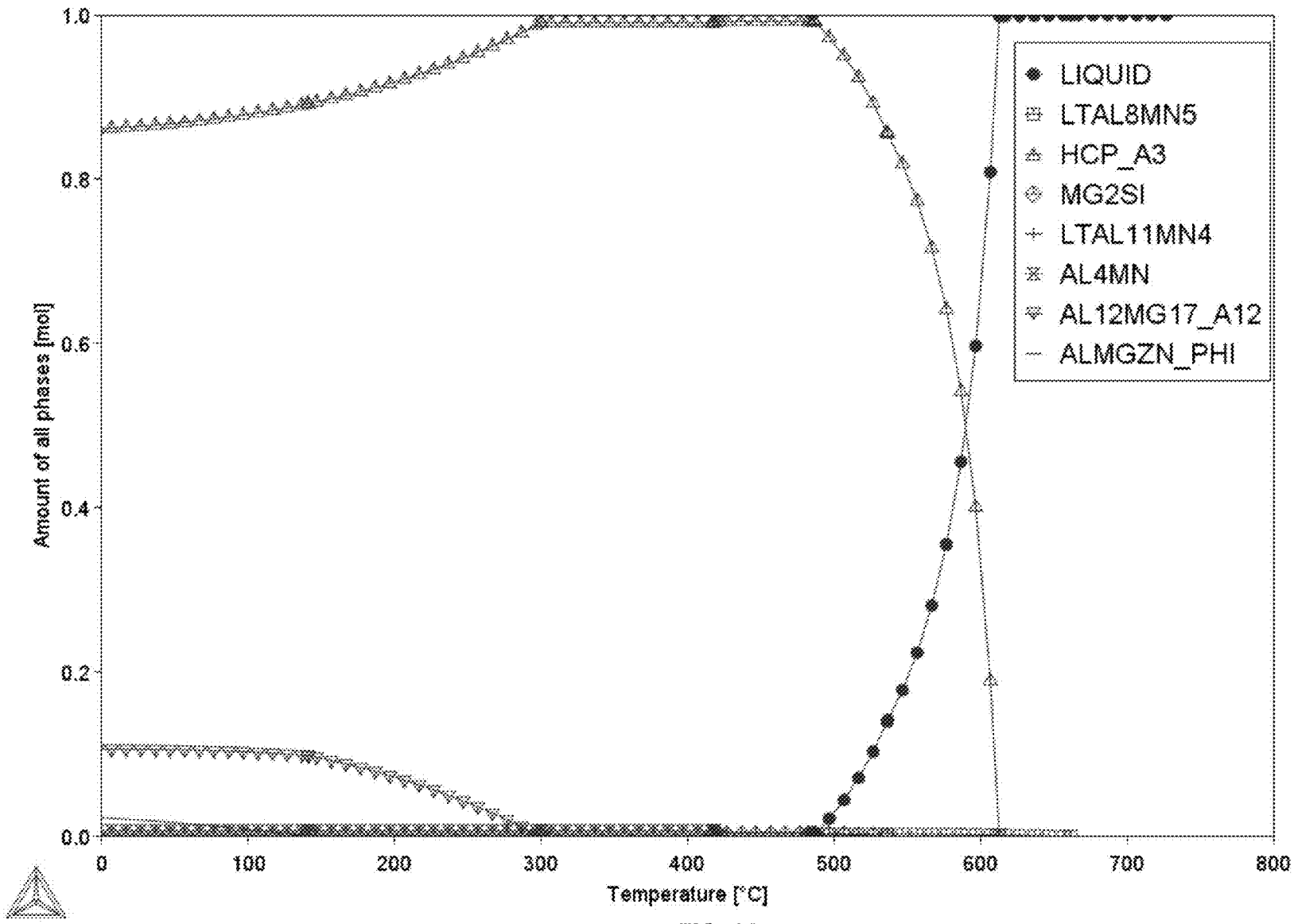
FIG. 28 shows the calculated equilibrium phase diagram for alloy A613.
Figure 29:
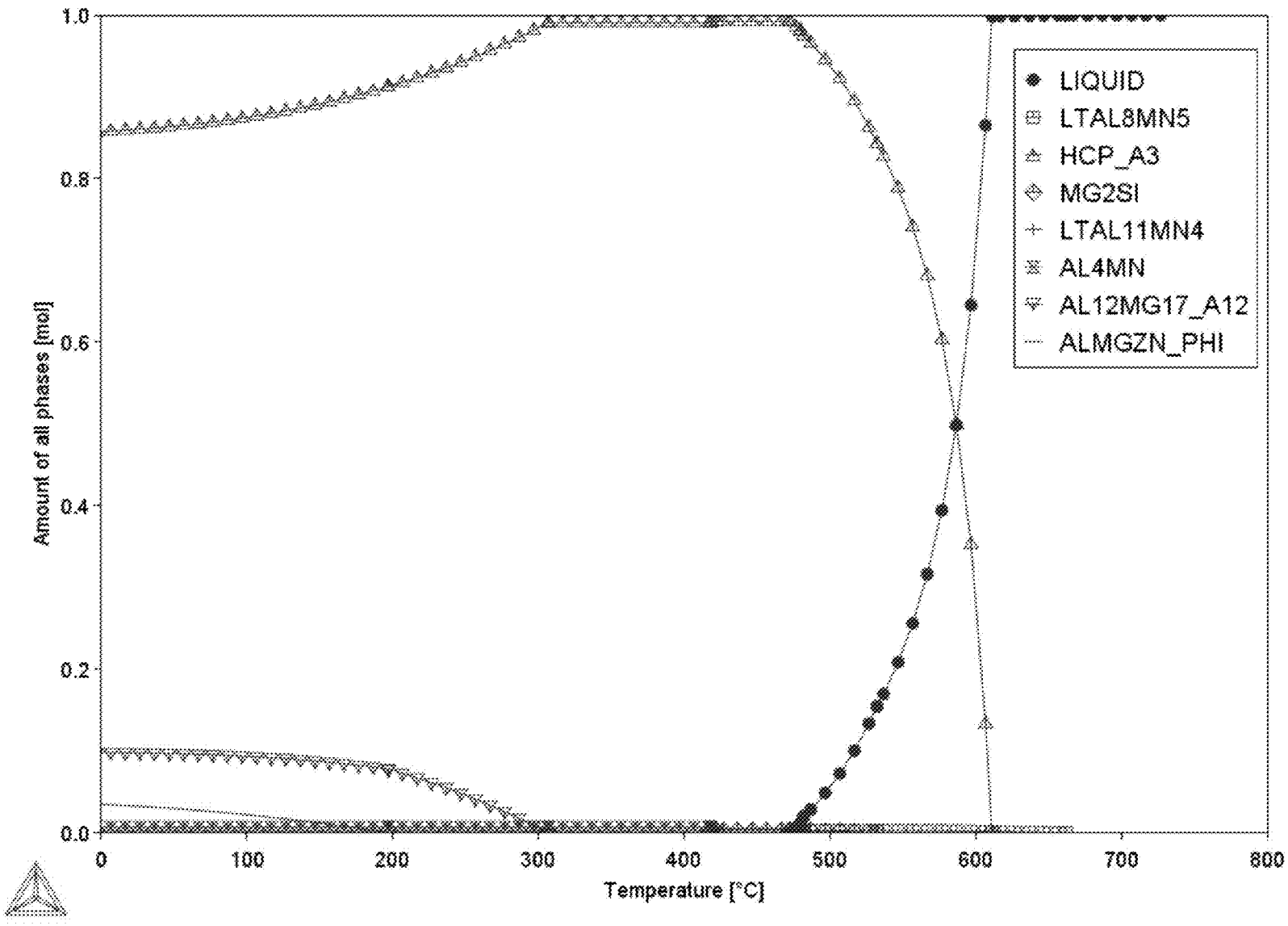
FIG. 29 shows the calculated equilibrium phase diagram for alloy A614.
Figure 30:
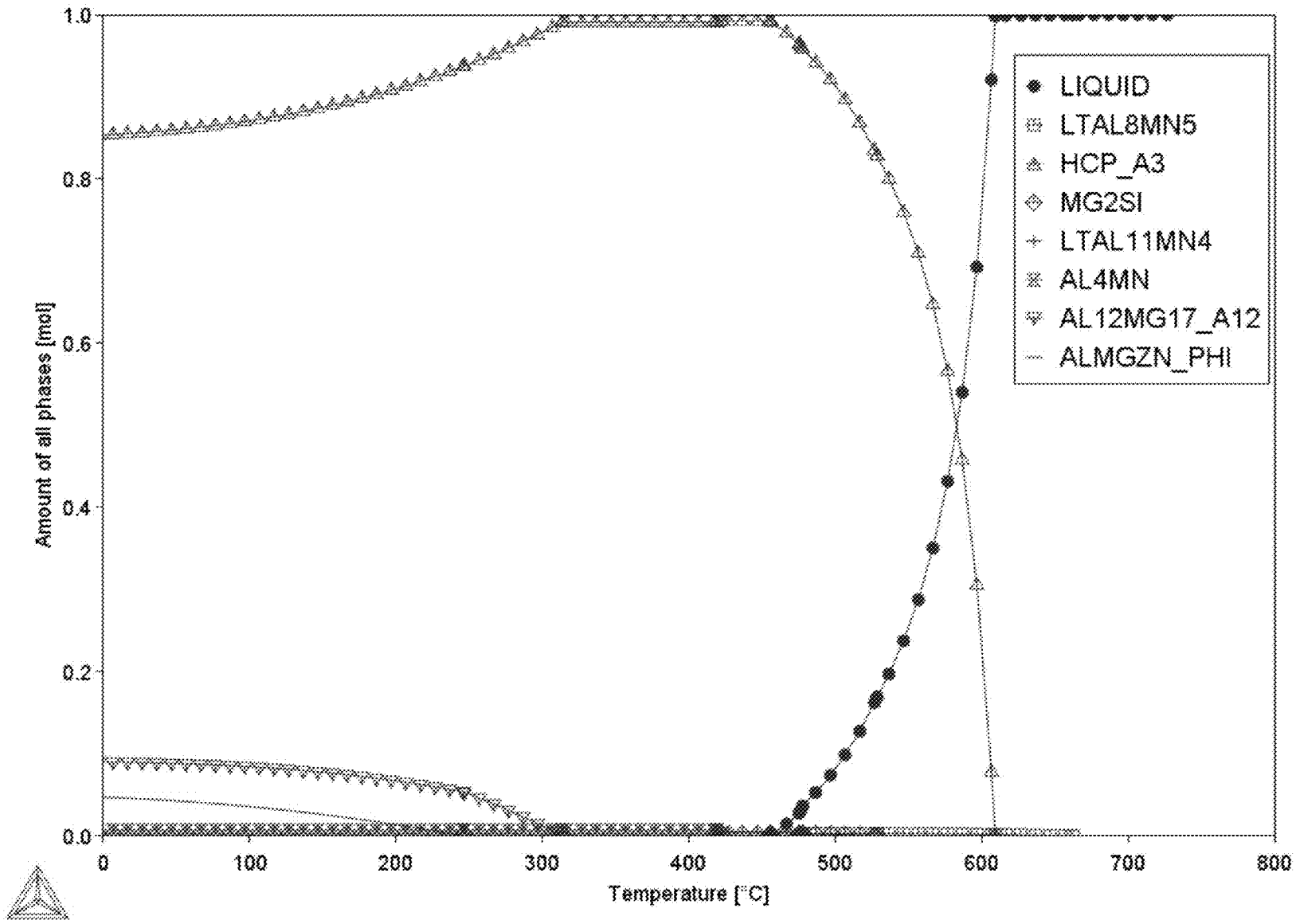
FIG. 30 shows the calculated equilibrium phase diagram for alloy A615.
Figure 31:
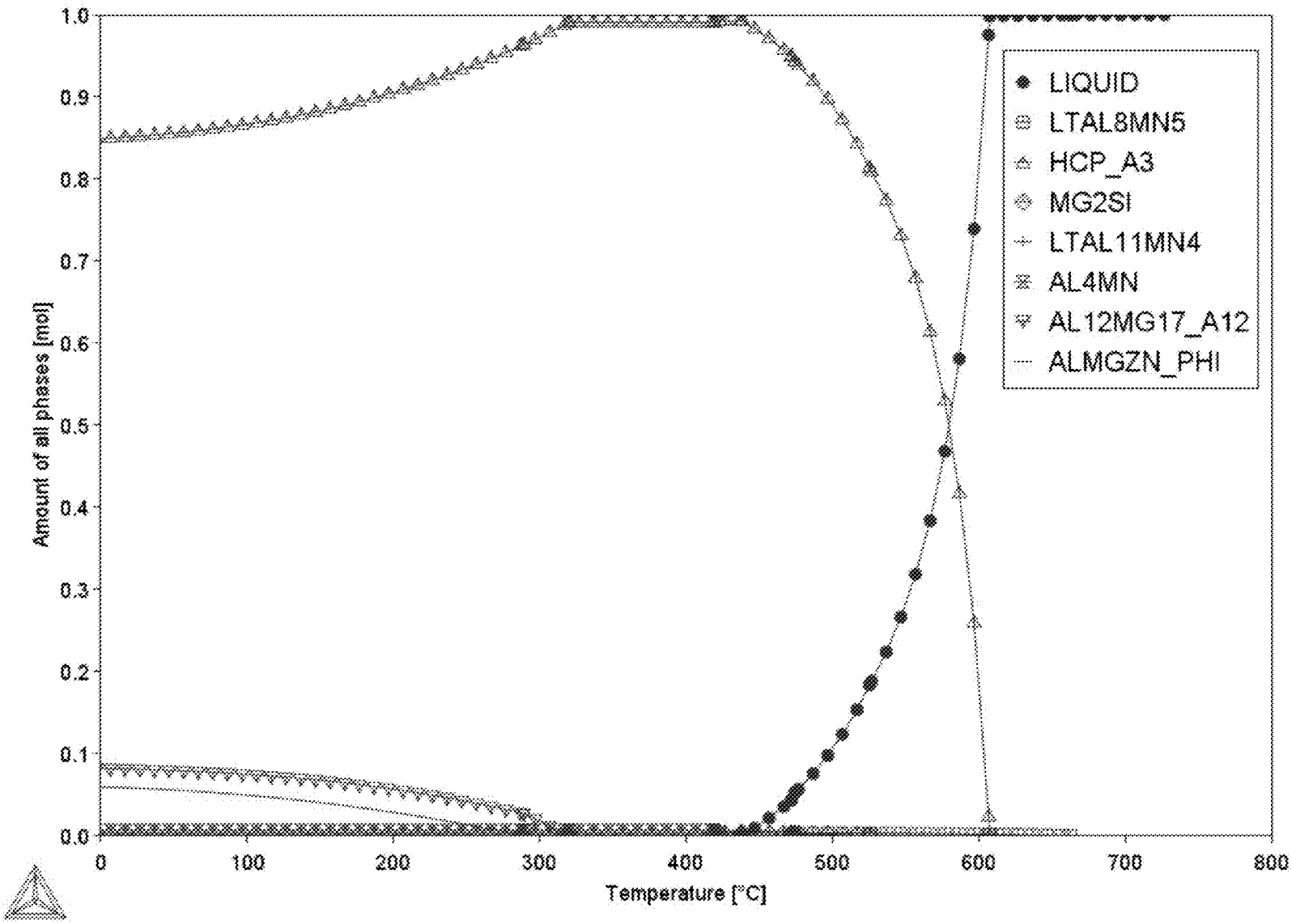
FIG. 31 shows the calculated equilibrium phase diagram for alloy A616.
Figure 32:
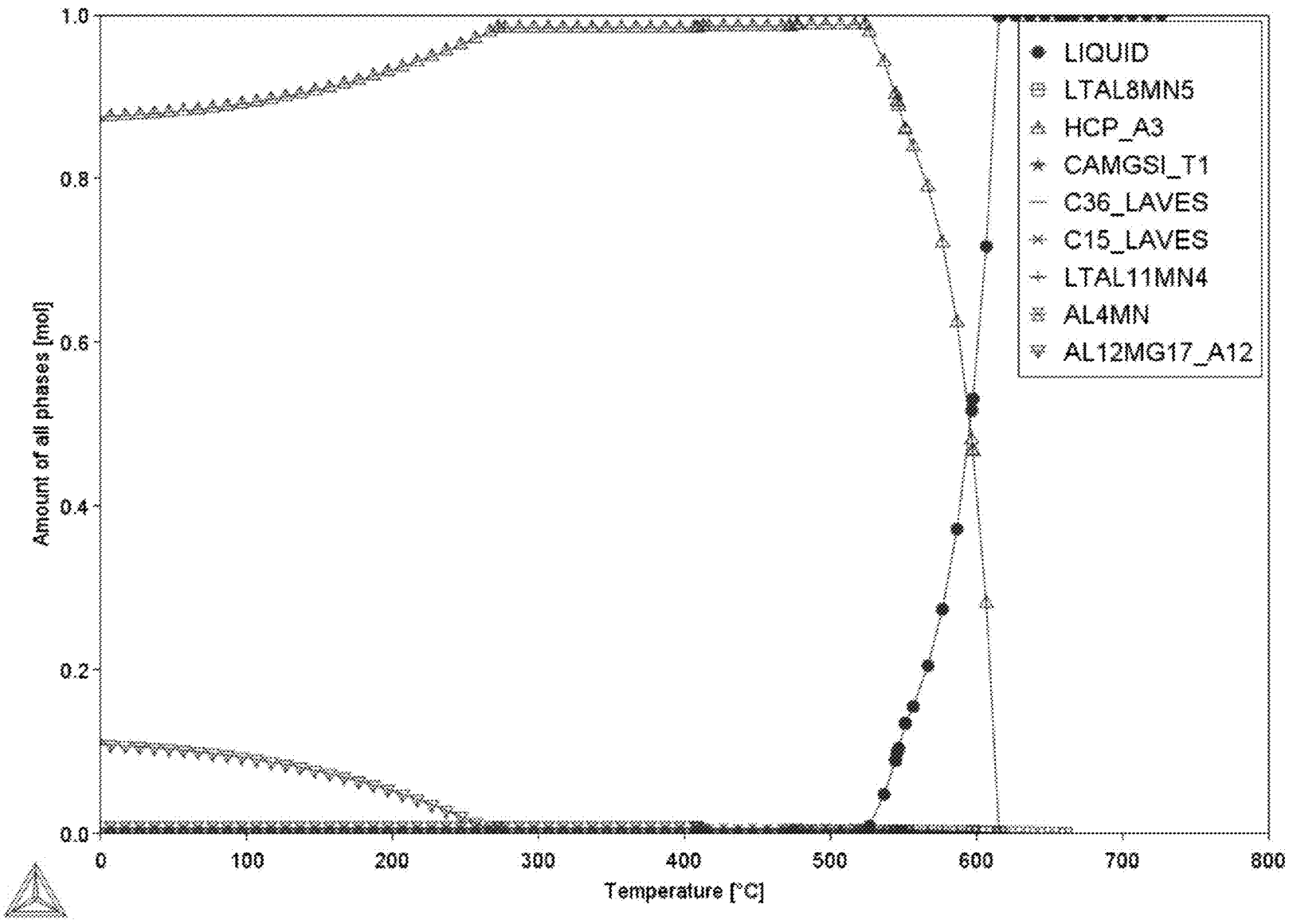
FIG. 32 shows the calculated equilibrium phase diagram for alloy A621.
Figure 33:
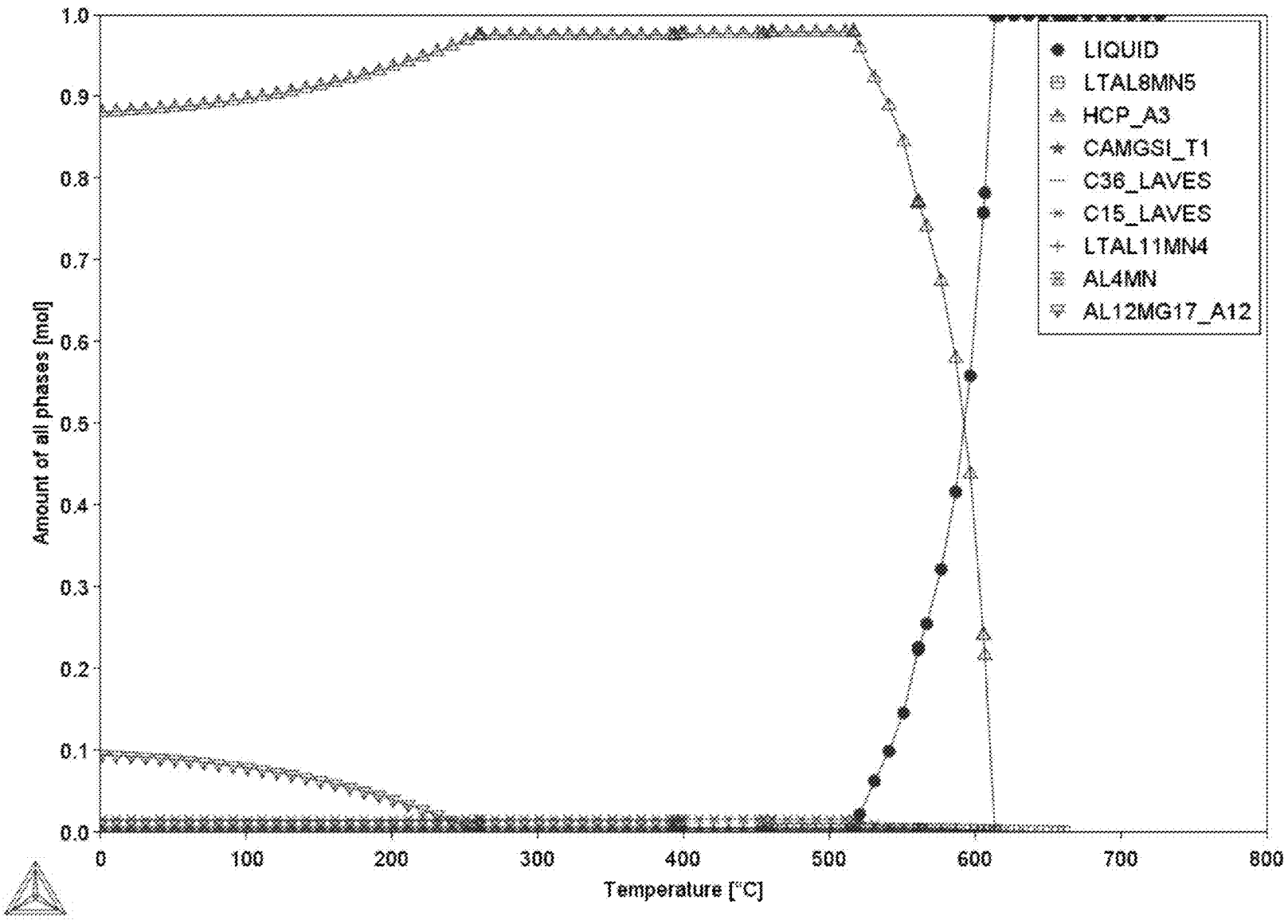
FIG. 33 shows the calculated equilibrium phase diagram for alloy A622.
Figure 34:
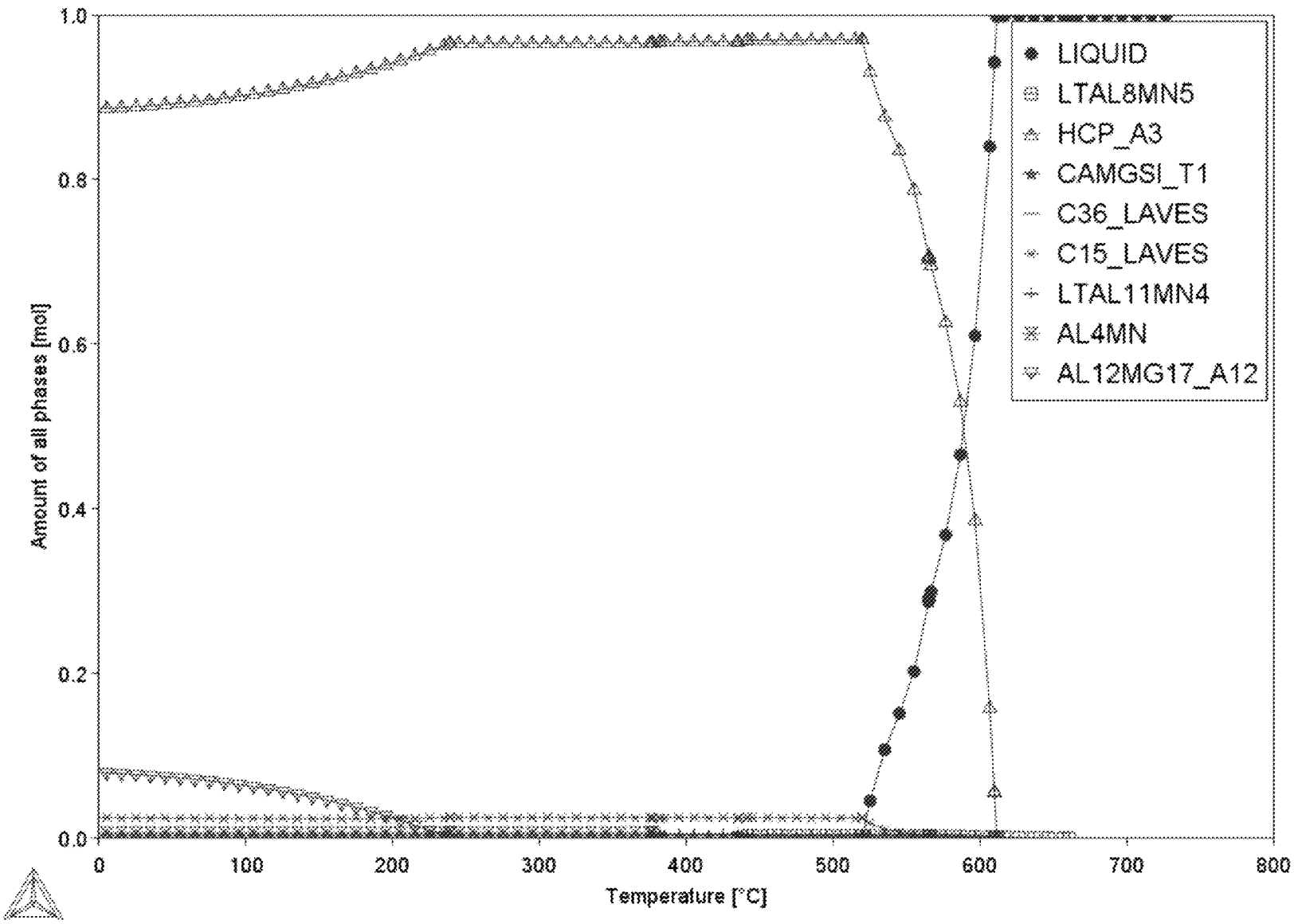
FIG. 34 shows the calculated equilibrium phase diagram for alloy A623.
Figure 35:
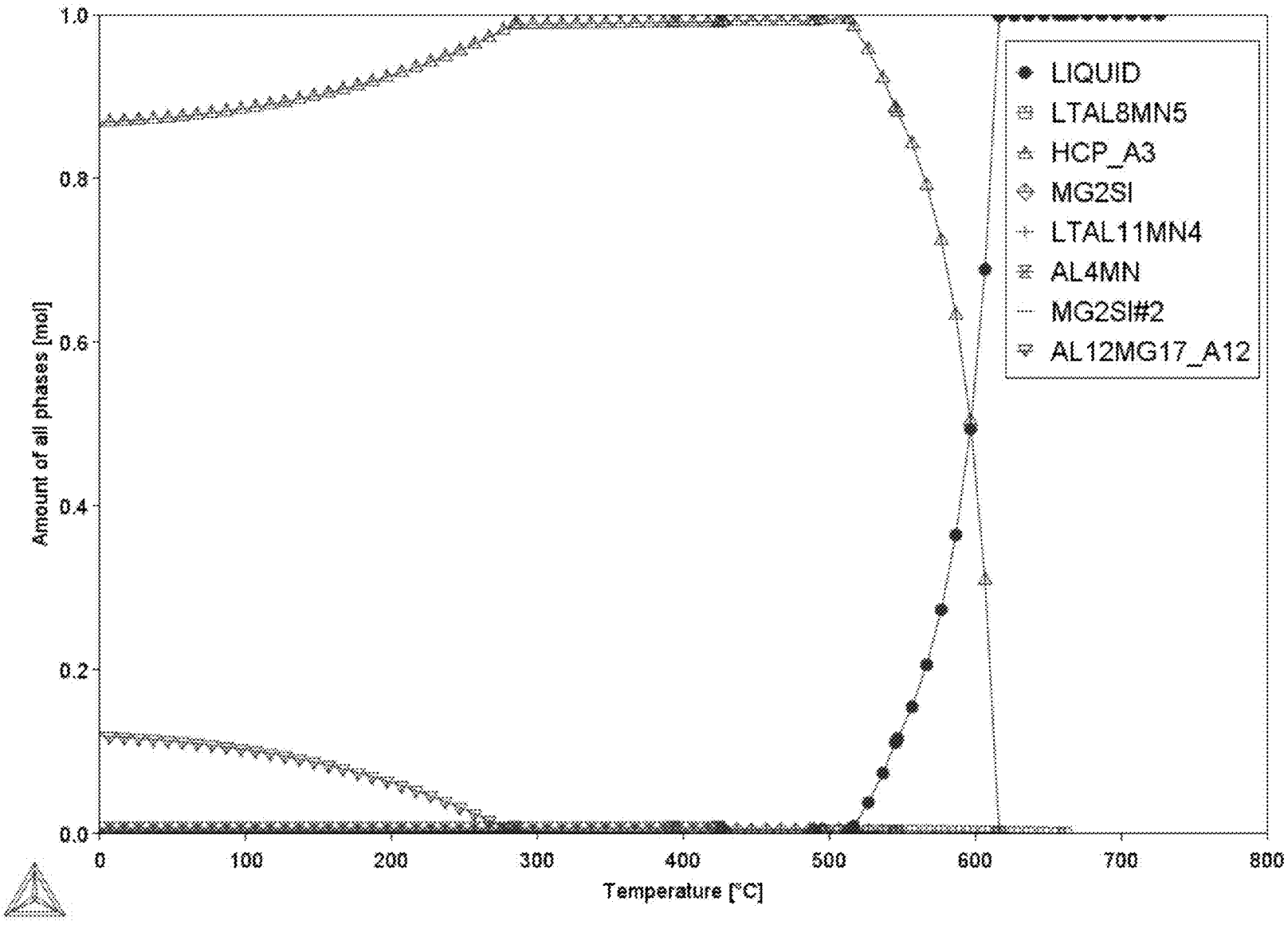
FIG. 35 shows the calculated equilibrium phase diagram for alloy A631.
Figure 36:
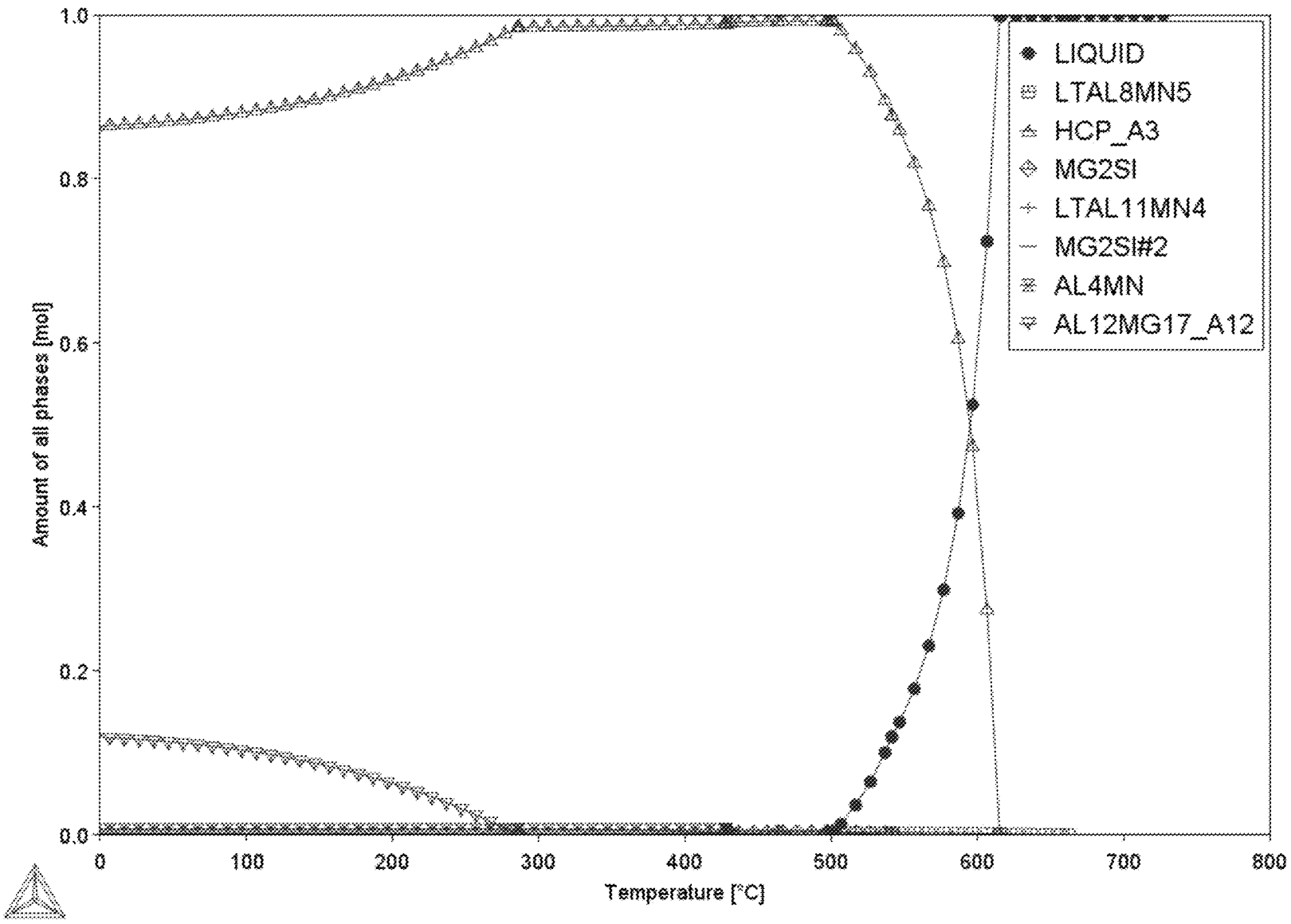
FIG. 36 shows the calculated equilibrium phase diagram for alloy A632.
Figure 37:
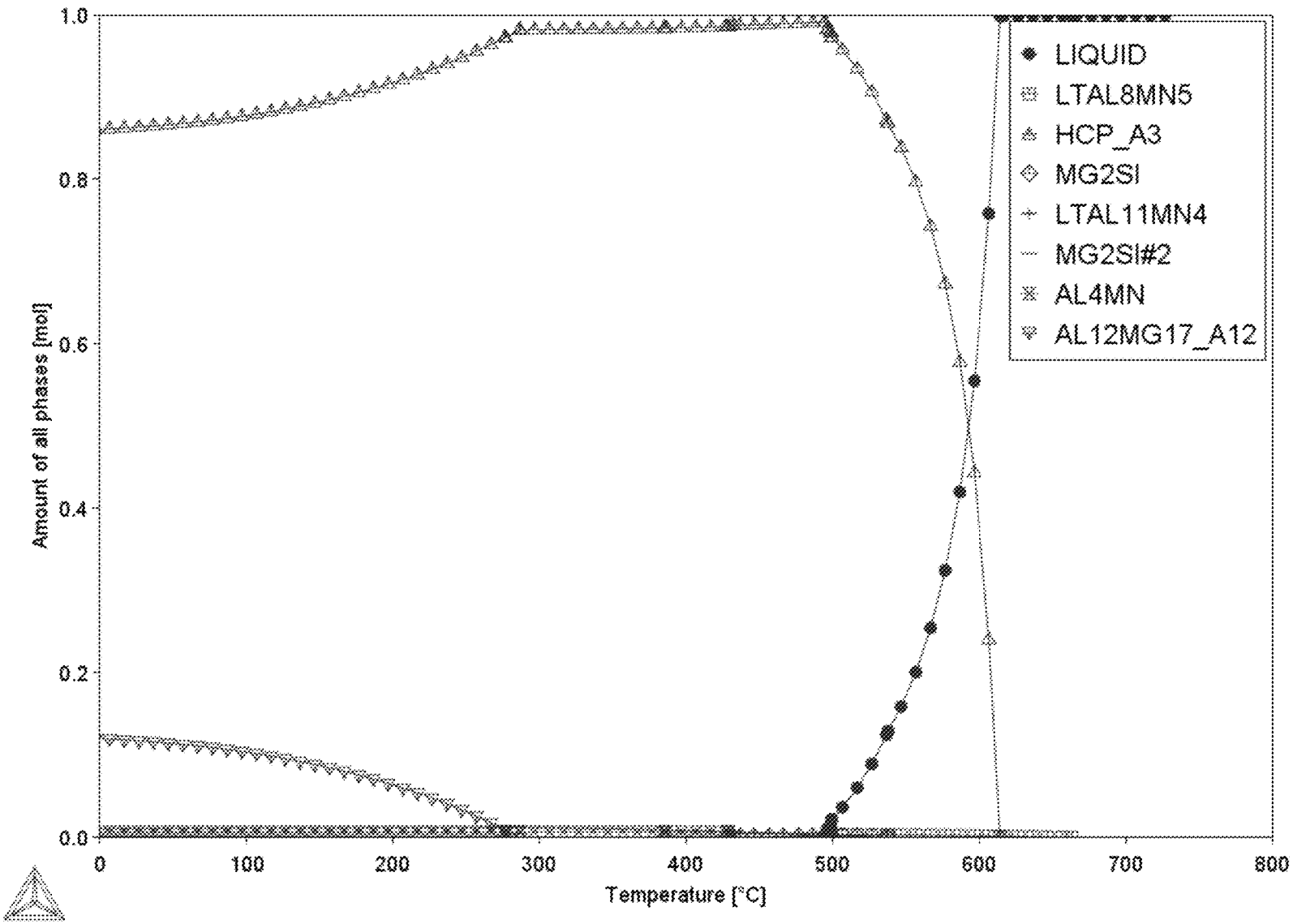
FIG. 37 shows the calculated equilibrium phase diagram for alloy A633.
Figure 38:
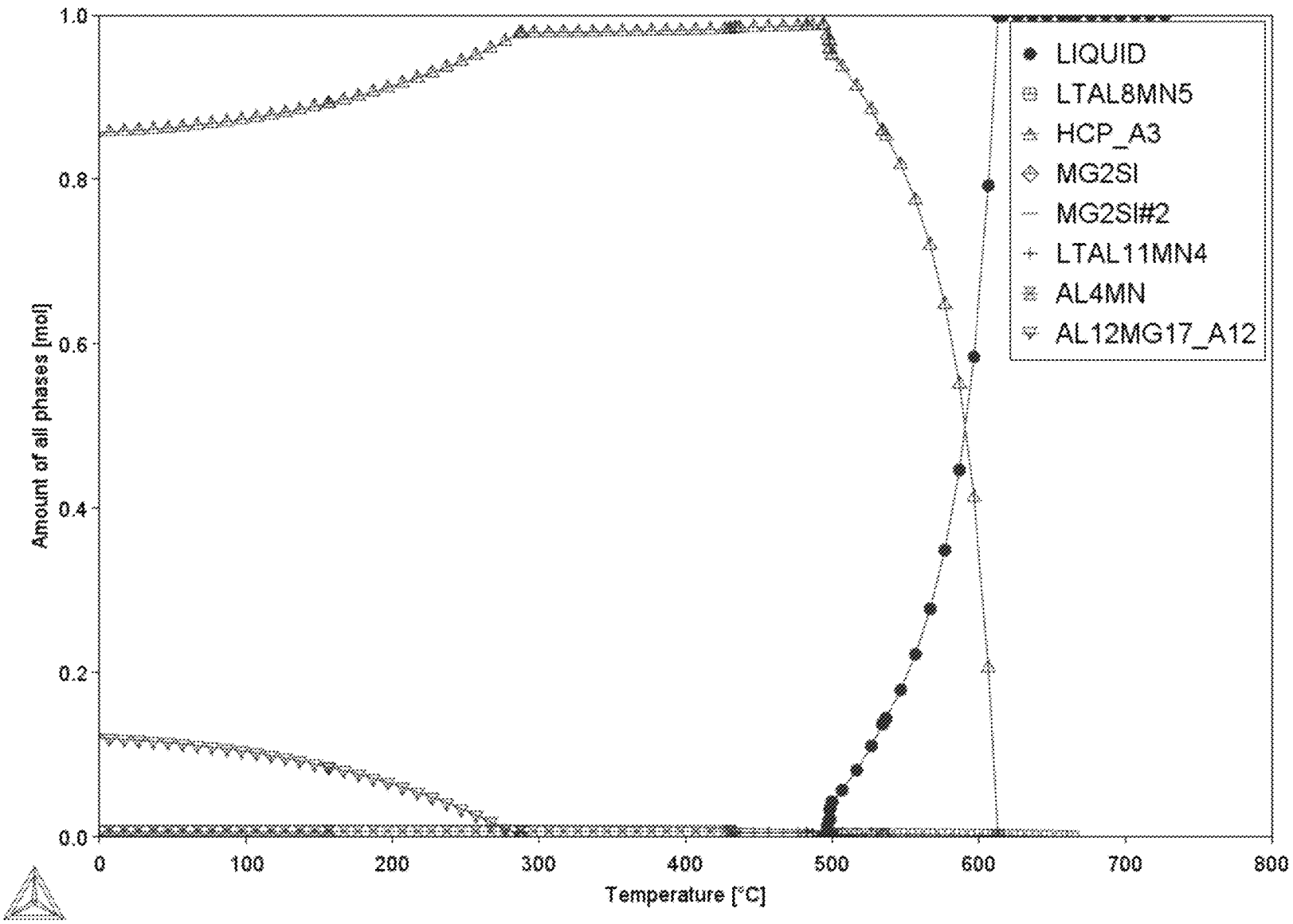
FIG. 38 shows the calculated equilibrium phase diagram for alloy A634.
Figure 39:
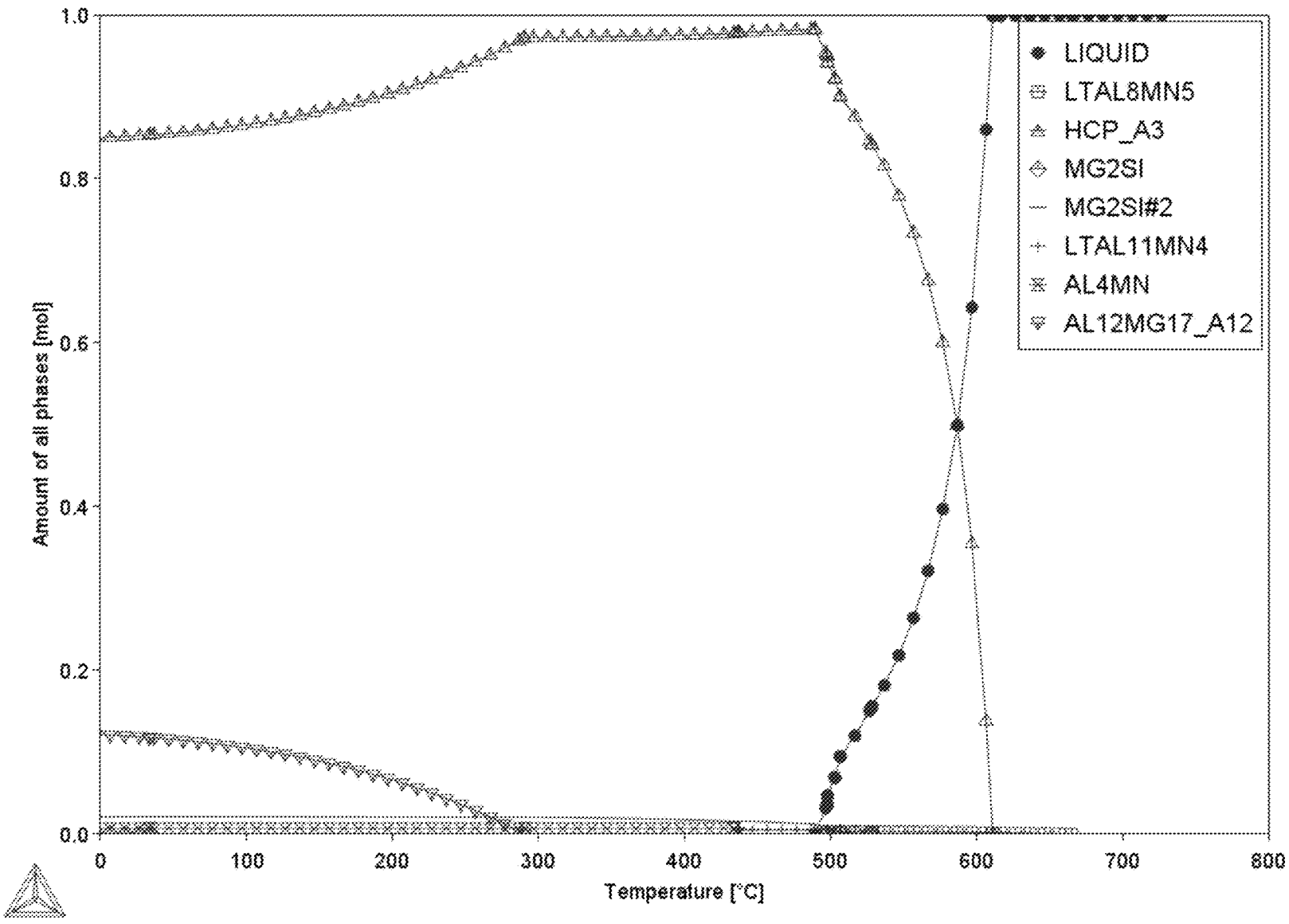
FIG. 39 shows the calculated equilibrium phase diagram for alloy A635.
Figure 40:
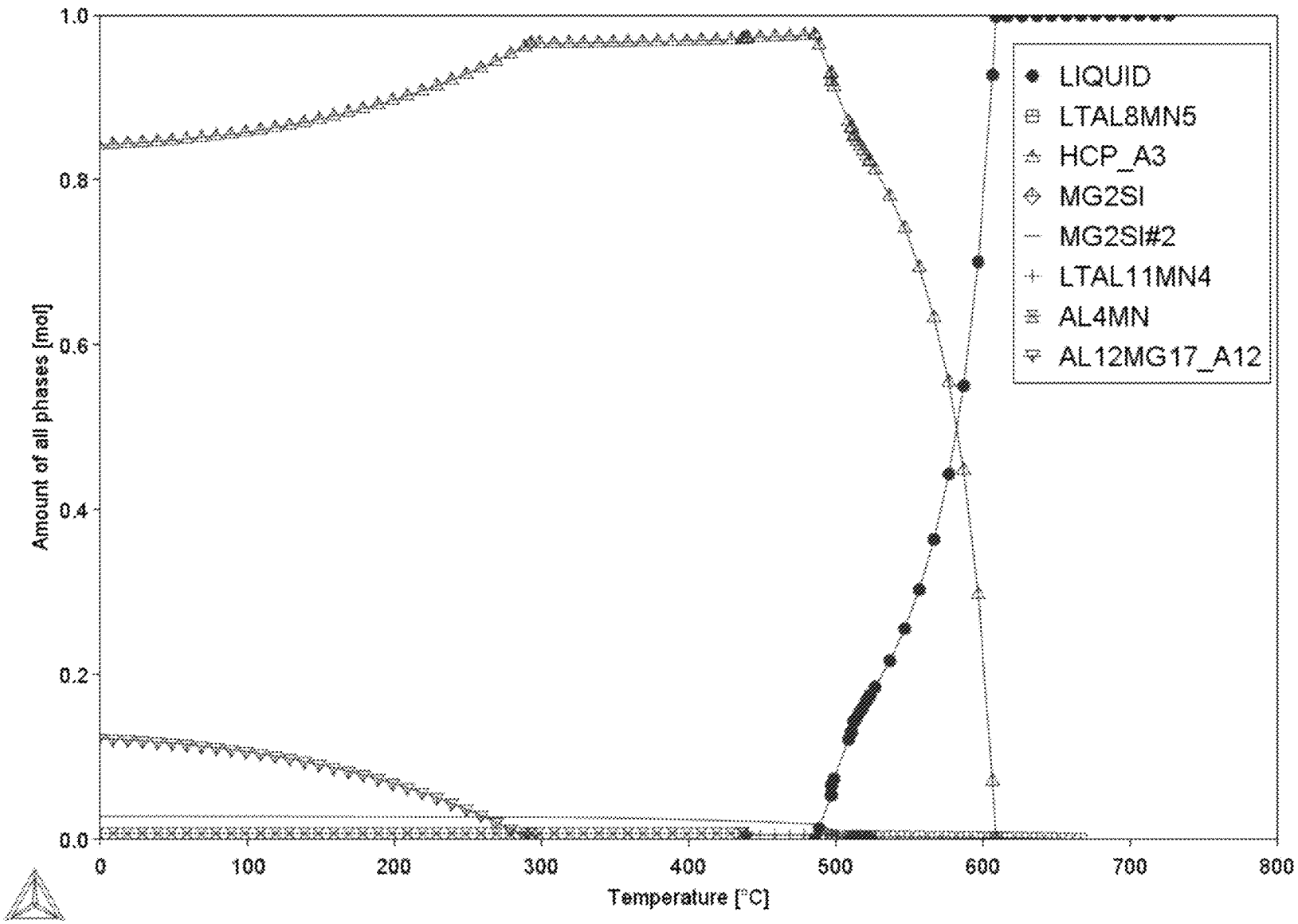
FIG. 40 shows the calculated equilibrium phase diagram for alloy A636.
Figure 41:
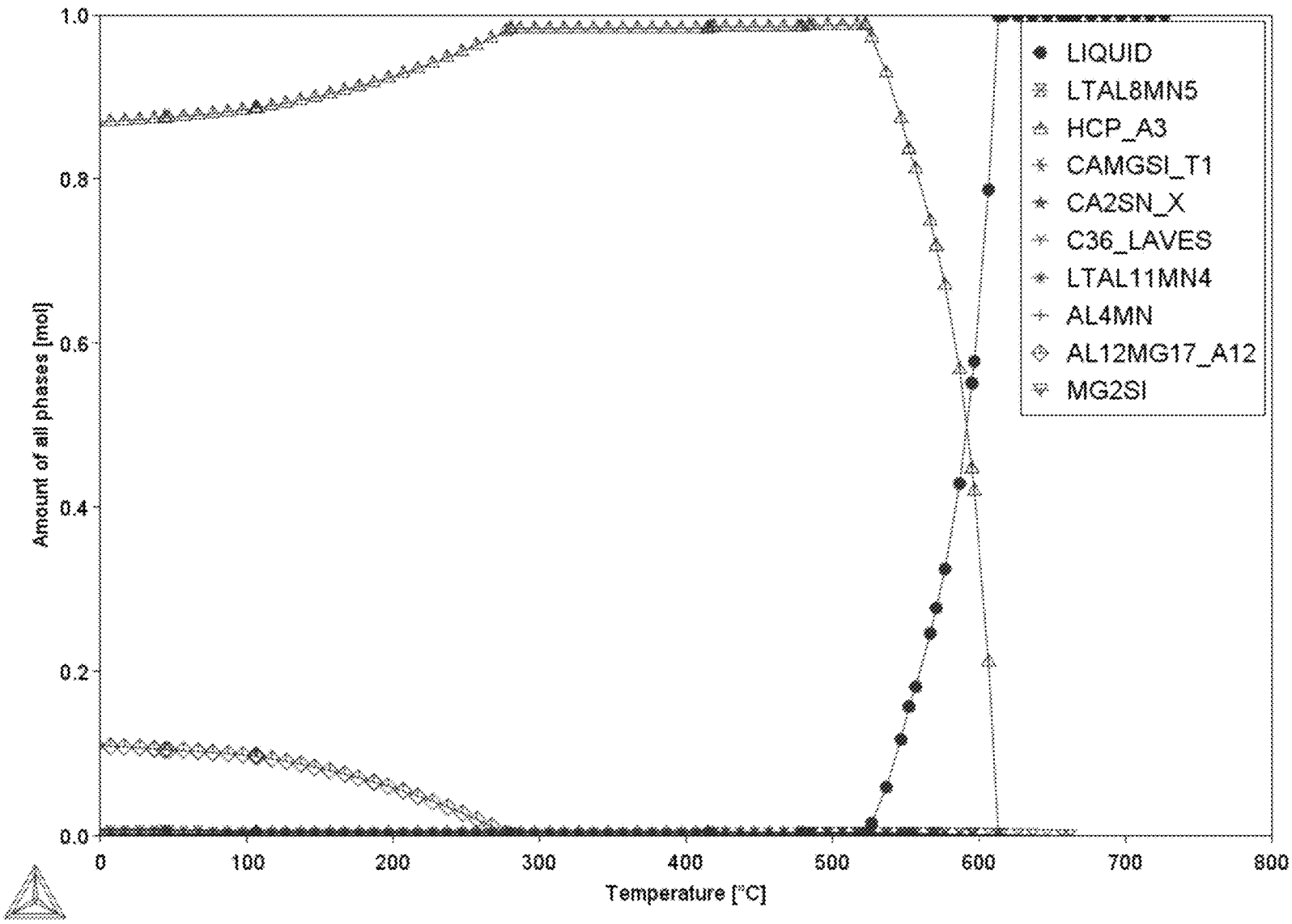
FIG. 41 shows the calculated equilibrium phase diagram for alloy A641.
Figure 42:
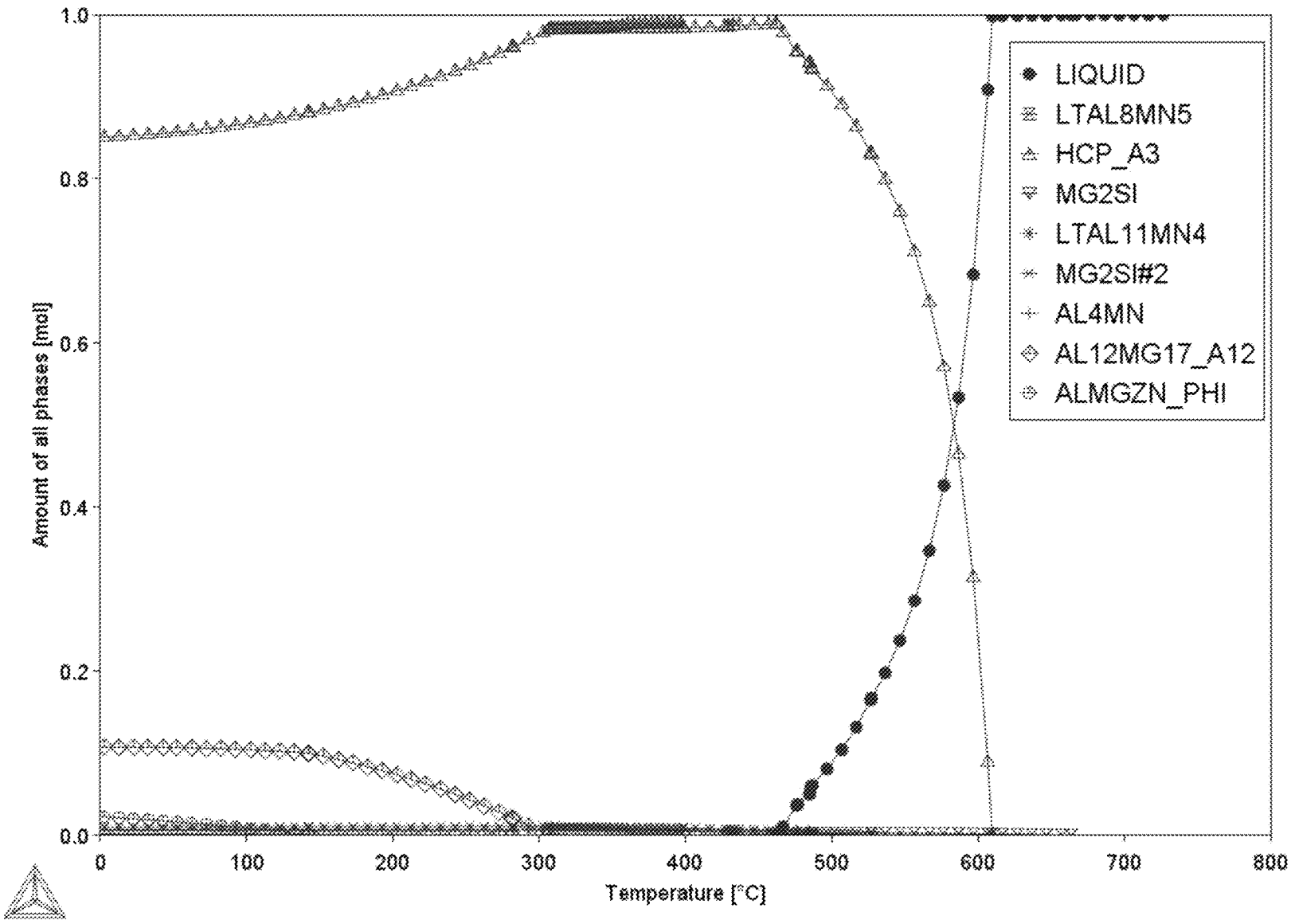
FIG. 42 shows the calculated equilibrium phase diagram for alloy A642.
Figure 43:
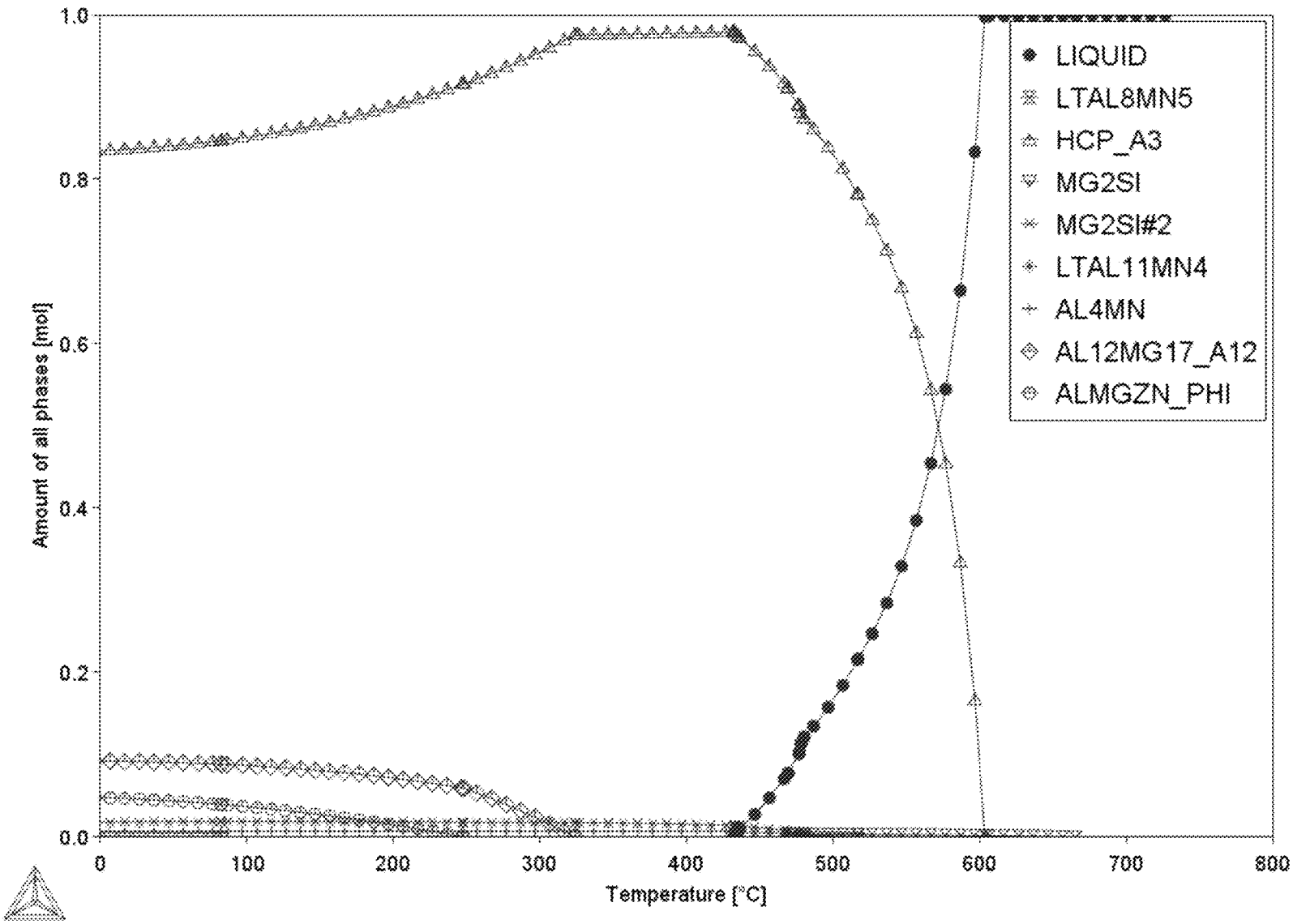
FIG. 43 shows the calculated equilibrium phase diagram for alloy A643.
Figure 44:
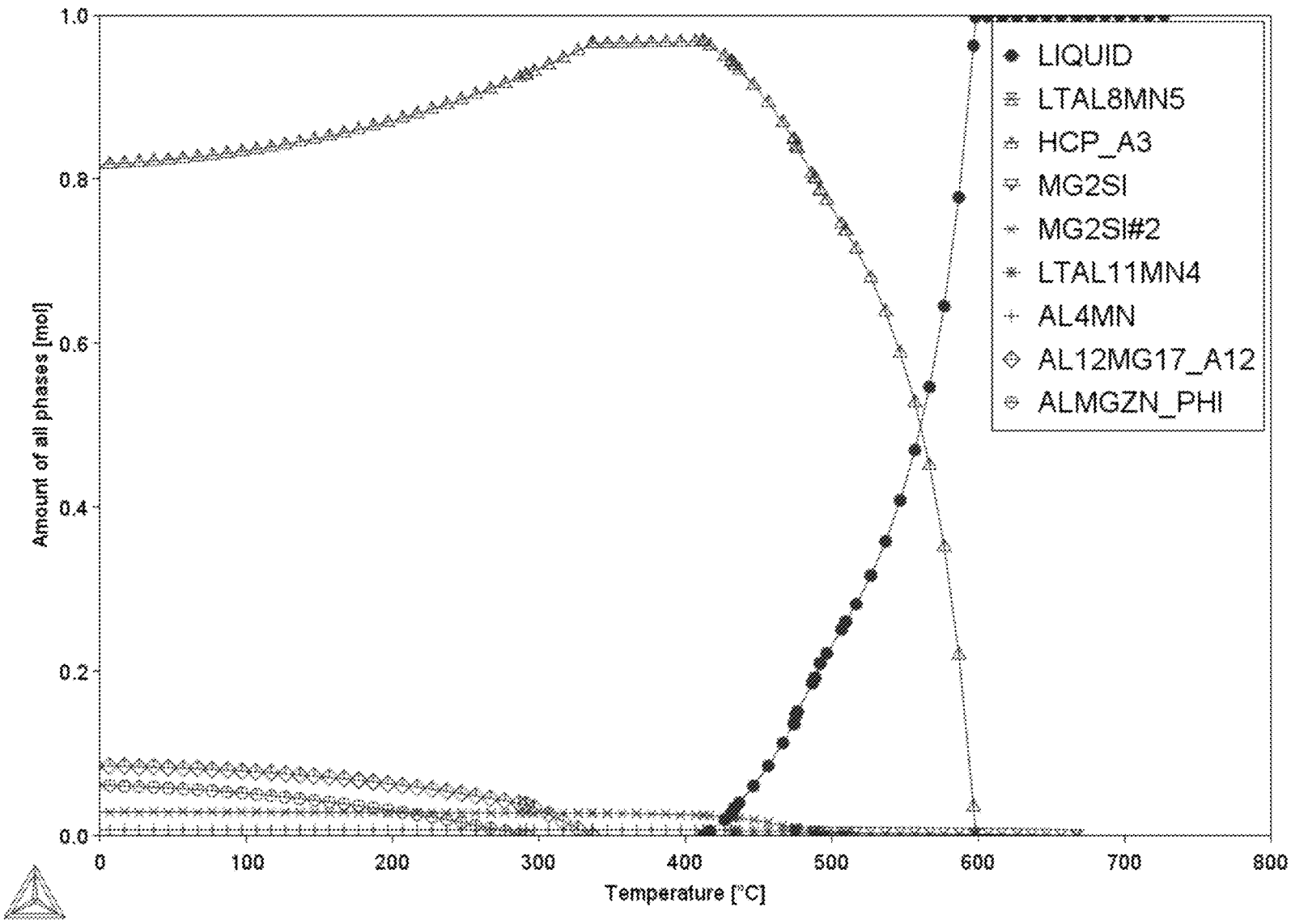
FIG. 44 shows the calculated equilibrium phase diagram for alloy A644.
Figure 45:
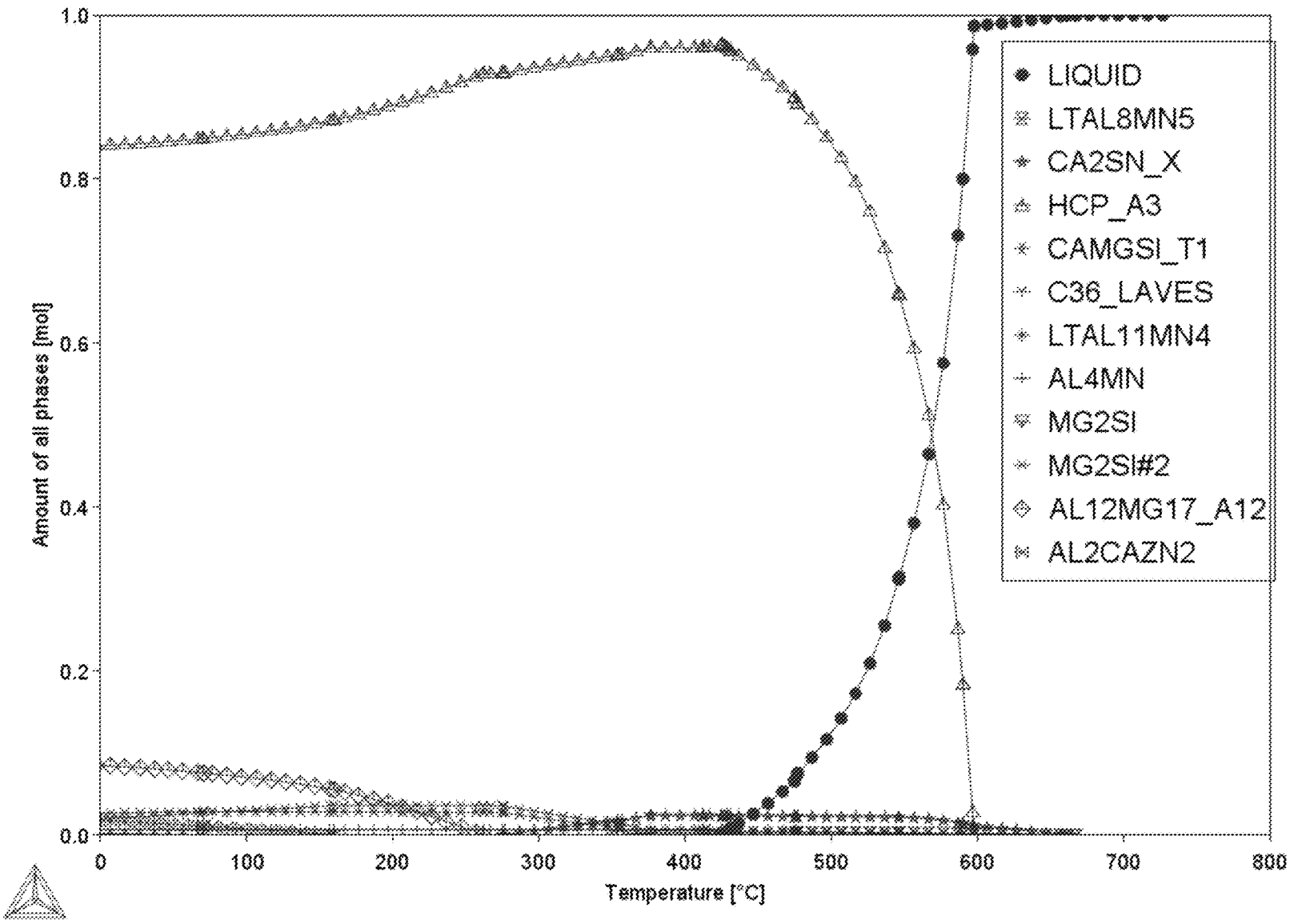
FIG. 45 shows the calculated equilibrium phase diagram for alloy A645.

FIG. 2 shows that alloy AZ91D which has good processability has a lower solidus and a larger melting range, which is the difference between the liquidus and the solidus. The magnesium alloys of the invention have solidus and melting ranges greater than that of AM50 and AM60B and closer to that of AZ91D and ductility comparable to AM60B and better than that of AZ91D.

A number of alloys were computationally evaluated for their solidus, liquidus, and solidification range. Table 2 shows nominal compositions of AM50, AM60B, and AZ91D along with the invention alloys.

TABLE 2

Nominal compositions of baseline and computationally designed invention alloys.

| Alloy Name | Mg | Zn | Al | Ca | Mn | Si | Sn | Sr/B |
|---|---|---|---|---|---|---|---|---|
| Baseline alloys | | | | | | | | |
| AM50 | Bal | 0.2 | 4.9 | 0.00 | 0.45 | 0.1 | 0.00 | 0 |
| AM60B | Bal | 0.18 | 6.1 | 0.00 | 0.3 | 0.1 | 0.00 | 0 |
| AZ91D | Bal | 0.77 | 8.73 | 0.00 | 0.24 | 0.01 | 0.01 | 0 |
| Invention Alloys | | | | | | | | |
| A511 | Bal | 0.5 | 4.9 | 0.00 | 0.45 | 0.10 | 0.00 | 0 |
| A512 | Bal | 1.0 | 4.9 | 0.00 | 0.45 | 0.10 | 0.00 | 0 |
| A513 | Bal | 1.5 | 4.9 | 0.00 | 0.45 | 0.10 | 0.00 | 0 |
| A514 | Bal | 2.0 | 4.9 | 0.00 | 0.45 | 0.10 | 0.00 | 0 |
| A515 | Bal | 2.5 | 4.9 | 0.00 | 0.45 | 0.10 | 0.00 | 0 |
| A516 | Bal | 3.0 | 4.9 | 0.00 | 0.45 | 0.10 | 0.00 | 0 |
| A521 | Bal | 0.2 | 4.9 | 0.50 | 0.45 | 0.10 | 0.00 | 0 |
| A522 | Bal | 0.2 | 4.9 | 1.00 | 0.45 | 0.10 | 0.00 | 0 |
| A523 | Bal | 0.2 | 4.9 | 1.50 | 0.45 | 0.10 | 0.00 | 0 |
| A531 | Bal | 0.2 | 4.9 | 0.00 | 0.45 | 0.10 | 0.50 | 0 |
| A532 | Bal | 0.2 | 4.9 | 0.00 | 0.45 | 0.10 | 1.00 | 0 |
| A533 | Bal | 0.2 | 4.9 | 0.00 | 0.45 | 0.10 | 1.50 | 0 |
| A534 | Bal | 0.2 | 4.9 | 0.00 | 0.45 | 0.10 | 2.00 | 0 |
| A535 | Bal | 0.2 | 4.9 | 0.00 | 0.45 | 0.10 | 3.00 | 0 |
| A536 | Bal | 0.2 | 4.9 | 0.00 | 0.45 | 0.10 | 4.00 | 0 |
| A541 | Bal | 0.5 | 4.9 | 0.5 | 0.45 | 0.10 | 0.50 | 0 |
| A542 | Bal | 1.5 | 4.9 | 0.0 | 0.45 | 0.10 | 1.50 | 0 |
| A543 | Bal | 2.5 | 4.9 | 0.0 | 0.45 | 0.10 | 2.50 | 0 |
| A544 | Bal | 3.0 | 4.9 | 0.0 | 0.45 | 0.1 | 4.00 | 0 |
| A545 | Bal | 3.0 | 4.9 | 1.5 | 0.45 | 0.1 | 4.00 | 0 |
| A611 | Bal | 0.5 | 6.1 | 0.00 | 0.3 | 0.10 | 0.00 | 0 |
| A612 | Bal | 1.0 | 6.1 | 0.00 | 0.3 | 0.10 | 0.00 | 0 |
| A613 | Bal | 1.5 | 6.1 | 0.00 | 0.3 | 0.10 | 0.00 | 0 |
| A614 | Bal | 2.0 | 6.1 | 0.00 | 0.3 | 0.10 | 0.00 | 0 |
| A615 | Bal | 2.5 | 6.1 | 0.00 | 0.3 | 0.10 | 0.00 | 0 |
| A616 | Bal | 3.0 | 6.1 | 0.00 | 0.3 | 0.10 | 0.00 | 0 |
| A621 | Bal | 0.18 | 6.1 | 0.50 | 0.3 | 0.10 | 0.00 | 0 |
| A622 | Bal | 0.18 | 6.1 | 1.00 | 0.3 | 0.10 | 0.00 | 0 |
| A623 | Bal | 0.18 | 6.1 | 1.50 | 0.3 | 0.10 | 0.00 | 0 |
| A631 | Bal | 0.18 | 6.1 | 0.00 | 0.3 | 0.10 | 0.50 | 0 |
| A632 | Bal | 0.18 | 6.1 | 0.00 | 0.3 | 0.10 | 1.00 | 0 |
| A633 | Bal | 0.18 | 6.1 | 0.00 | 0.3 | 0.10 | 1.50 | 0 |
| A634 | Bal | 0.18 | 6.1 | 0.00 | 0.3 | 0.10 | 2.00 | 0 |
| A635 | Bal | 0.18 | 6.1 | 0.00 | 0.3 | 0.10 | 3.00 | 0 |
| A636 | Bal | 0.18 | 6.1 | 0.00 | 0.3 | 0.10 | 4.00 | 0 |
| A641 | Bal | 0.5 | 6.1 | 0.5 | 0.3 | 0.10 | 0.50 | 0 |
| A642 | Bal | 1.5 | 6.1 | 0.0 | 0.3 | 0.10 | 1.50 | 0 |
| A643 | Bal | 2.5 | 6.1 | 0.0 | 0.3 | 0.10 | 2.5 | 0 |
| A644 | Bal | 3.0 | 6.1 | 0.0 | 0.3 | 0.10 | 4.0 | 0 |
| A645 | Bal | 3.0 | 6.1 | 1.5 | 0.3 | 0.1 | 4.0 | 0 |

Table 3 shows the calculated liquidus, solidus, and melting ranges of AZ91D, AM50, and AM60B and those of the invention alloys.

TABLE 3

Calculated Liquidus, Solidus, Melting Range, and Decrease in Solidus for Invention Alloys

| Alloy # | Liquidus (° C.) | Solidus (° C.) | Melting range (° C.) | Decrease in solidus(° C.) |
|---|---|---|---|---|
| AZ91D | 656.85 | 469.51 | 187.34 | |
| AM50 | 676.85 | 547.93 | 128.92 | |
| A511 | 676.85 | 538.69 | 138.16 | 9.24 |
| A512 | 676.85 | 522.95 | 153.90 | 24.98 |
| A513 | 676.85 | 506.80 | 170.05 | 41.13 |
| A514 | 676.85 | 490.30 | 186.55 | 57.63 |
| A515 | 676.85 | 473.41 | 203.44 | 74.52 |
| A516 | 676.85 | 456.14 | 220.71 | 91.79 |
| A521 | 676.85 | 544.24 | 132.61 | 3.69 |
| A522 | 676.85 | 531.66 | 145.19 | 16.27 |
| A523 | 676.85 | 531.85 | 145.00 | 16.08 |
| A531 | 676.85 | 538.35 | 138.50 | 9.58 |

TABLE 3-continued

Calculated Liquidus, Solidus, Melting Range, and Decrease in Solidus for Invention Alloys

| Alloy # | Liquidus (° C.) | Solidus (° C.) | Melting range (° C.) | Decrease in solidus(° C.) |
|---|---|---|---|---|
| A532 | 676.85 | 528.42 | 148.43 | 19.51 |
| A533 | 676.85 | 518.13 | 158.72 | 29.80 |
| A534 | 676.85 | 507.48 | 169.37 | 40.45 |
| A535 | 676.85 | 504.16 | 172.69 | 43.77 |
| A536 | 676.85 | 498.87 | 177.98 | 49.06 |
| A541 | 676.85 | 545.11 | 131.74 | 2.82 |
| A542 | 676.85 | 472.85 | 204.00 | 75.08 |
| A543 | 676.50 | 447.28 | 229.22 | 100.65 |
| A544 | 686.85 | 426.29 | 260.56 | 121.64 |
| A545 | 686.85 | 448.52 | 238.33 | 99.41 |
| AM60B | 656.85 | 526.25 | 130.60 | 0.00 |
| A611 | 656.85 | 516.62 | 140.23 | 9.63 |
| A612 | 656.85 | 501.22 | 155.63 | 25.03 |
| A613 | 656.85 | 486.27 | 170.58 | 39.98 |
| A614 | 656.85 | 472.12 | 184.73 | 54.13 |
| A615 | 656.85 | 455.51 | 201.34 | 70.74 |
| A616 | 656.85 | 438.49 | 218.36 | 87.76 |
| A621 | 656.85 | 523.89 | 132.96 | 2.36 |
| A622 | 656.85 | 516.65 | 140.20 | 9.60 |
| A623 | 656.85 | 519.90 | 136.95 | 6.35 |
| A631 | 656.85 | 513.25 | 143.60 | 13.00 |
| A632 | 656.85 | 500.94 | 155.91 | 25.31 |
| A633 | 656.85 | 494.80 | 162.05 | 31.45 |
| A634 | 656.85 | 494.32 | 162.53 | 31.93 |
| A635 | 656.85 | 489.47 | 167.38 | 36.78 |
| A636 | 656.85 | 486.03 | 170.82 | 40.22 |
| A641 | 656.85 | 522.54 | 134.31 | 3.71 |
| A642 | 656.85 | 462.16 | 194.69 | 64.09 |
| A643 | 656.85 | 432.09 | 224.76 | 94.16 |
| A644 | 666.86 | 412.28 | 254.58 | 113.97 |
| A645 | 665.85 | 425.03 | 240.82 | 101.22 |

As shown in Table 3, the invention alloys A511-A545 have a solidus lower than and a melting range larger than that of AM50. Also, several alloys have achieved a melting range comparable to or greater than that of AZ91D.

Also as shown in Table 3, the invention alloys A611-A645 have a solidus lower than and a melting range larger than that of AM60B. Also, several alloys have achieved a melting range comparable to or greater than that of AZ91D.

A511 to A516 have increasing levels only of Zn. A521 to A523 have increasing levels only of Ca, and A531 to A536 have increasing levels only of Sn. A541 to A545 have increasing levels of Zn, Sn and Ca, where two or three of these elements have increasing values. These levels of elements decrease the solidus and increase the melting range when compared to that of AM50.

A611 to A616 have increasing levels only of Zn. A621 to A623 have increasing levels only of Ca, and A631 to A636 have increasing levels only of Sn. A641 to A645 have increasing levels of Zn, Sn and Ca, where two or three of these elements have increasing values. These levels of elements decrease the solidus and increase the melting range when compared to that of AM60B.

Table 4 shows some compositions of invention alloys selected for testing. These alloys were fabricated in laboratory scale heats and tested for their solidus, liquidus and melting range. Table 5 shows the measured compositions of these example invention alloys.

TABLE 4

Nominal compositions of example invention alloys.

| Alloy # | Alloy Name | Mg | Zn | Al | Mn | Si | Sn | B |
|---|---|---|---|---|---|---|---|---|
| Al1 | AM60B | 93.31 | 0.18 | 6.1 | 0.3 | 0.1 | 0 | 0 |
| Al2 | AM60B + Zn | 92.08 | 1.50 | 6.02 | 0.30 | 0.10 | 0.00 | 0 |
| Al3 | AM60B + Sn | 91.93 | 0.18 | 6.01 | 0.30 | 0.10 | 1.48 | 0 |
| Al4 | AM60B + Zn + Sn | 90.66 | 1.51 | 5.93 | 0.29 | 0.10 | 1.51 | 0 |
| Al5 | AM50 + Zn + Sn | 91.54 | 1.50 | 4.93 | 0.44 | 0.10 | 1.49 | 0 |
| Al11 | AM60B + B | 93.29 | 0.04 | 6.11 | 0.39 | 0.02 | 0.00 | 0.15 |
| Al12 | AM60B + Zn + B | 91.91 | 1.51 | 6.02 | 0.39 | 0.02 | 0.00 | 0.15 |
| Al13 | AM60B + Sn + B | 91.88 | 0.04 | 6.02 | 0.39 | 0.02 | 1.50 | 0.15 |
| Al14 | AM60B + Zn + Sn + B | 90.52 | 1.50 | 5.93 | 0.38 | 0.02 | 1.50 | 0.15 |
| Al15 | AM50 + Zn + Sn + B | 91.49 | 1.50 | 4.96 | 0.40 | 0.02 | 1.51 | 0.12 |

TABLE 5

Measured compositions of example invention alloys.

| Alloy # | Alloy Name | Mg | Zn | Al | Mn | Si | Sn | B |
|---|---|---|---|---|---|---|---|---|
| Al1M | AM60B | 93.59 | 0.06 | 6.04 | 0.28 | 0.03 | 0 | <0.005 |
| Al2M | AM60B + Zn | 92.09 | 1.76 | 5.84 | 0.28 | 0.03 | 0.00 | <0.005 |
| Al3M | AM60B + Sn | 91.80 | 0.08 | 6.08 | 0.27 | 0.03 | 1.74 | <0.005 |
| Al4M | AM60B + Zn + Sn | 90.60 | 1.68 | 5.77 | 0.29 | 0.03 | 1.65 | <0.005 |
| Al5M | AM50 + Zn + Sn | 91.54 | 2.10 | 4.86 | 0.22 | 0.03 | 1.50 | <0.005 |
| Al11M | AM60B + B | 93.76 | 0.06 | 5.82 | 0.26 | 0.03 | 0.00 | <0.005 |
| Al12M | AM60B + Zn + B | 92.45 | 1.2 | 6.06 | 0.26 | 0.03 | 0.00 | <0.005 |
| Al13M | AM60B + Sn + B | 92.17 | 0.07 | 6.10 | 0.31 | 0.03 | 1.13 | 0.15 |
| Al14M | AM60B + Zn + Sn + B | 90.45 | 1.53 | 6.34 | 0.33 | 0.03 | 1.3 | <0.005 |
| Al15M | AM50 + Zn + Sn + B | 91.7 | 1.20 | 5.61 | 0.3 | 0.02 | 1.16 | <0.005 |

Table 6 shows the effect of additions of Zn (Al2M), Sn (Al3M), and both Zn and Sn (Al4M) on the measured solidus of these alloys when compared to that of AM60B (Al1M) without these additions. Additions of Zn and Sn reduce the solidus much more effectively than the addition of Zn only or Sn only.

The solidus of A15M which contains additions of Zn and Sn (516) is significantly lower than that of AM50 (as shown in Table 3, 547.93) without these additions. Additions of Zn and Sn are effective in reducing the solidus and increasing the melting range.

TABLE 6

Measured melting range of invention alloys compared with calculated melting range of AZ91D

| Alloy # | Alloy | Liquidus (° C.) | Solidus (° C.) | Measured Melting range (° C.) |
|---|---|---|---|---|
| Baseline | AZ91D | 656.85 | 469.5 | 187.35 (calculated) |
| AI1M | AM60B | 655 | 537 | 118 |
| AI2M | AM60B + Zn | 633 | 515 | 118 |
| AI3M | AM60B + Sn | 636 | 526 | 110 |
| AI4M | AM60B + Zn + Sn | 641 | 470 | 171 |
| AI5M | AM50 + Zn + Sn | 635 | 516 | 119 |
| AI11M | AM60B + B | 641 | 531 | 110 |
| AI12M | AM60B + Zn + B | 645 | 501 | 144 |
| AI13M | AM60B + Sn + B | 652 | 537 | 115 |
| AI14M | AM60B + Zn + Sn + B | 645 | 501 | 144 |
| AI15M | AM50 + Zn + Sn + B | 645 | 506.5 | 138.5 |

Table 6 also shows that additions of Zn+B together (Al12M) and Zn+Sn+B (Al14M) are also effective in reducing the solidus when compared to AM60B, with Zn+B (501) (Al12M) and Zn+Sn+B (501) (Al14M) as compared to AM60B (537) without these additions.

The solidus of Al15M which contains additions of Zn+Sn+B (506.5) is significantly lower than that of AM50 (as shown in Table 3, 547.93) without these additions. Additions of Zn+Sn+B are effective in reducing the solidus and increasing the melting range.

The amounts of Zn, Ca, and Sn can have relative concentrations as shown in Equations 1 and 2:

$$P = 32 \times wt.\ \%\ \text{Zn}) + (9 + wt.\ \%\ \text{Ca}) + (18 \times wt.\ \%\ \text{Sn}) \text{ when } wt.\ \%\ of\ \text{Sn} \leq 2 \quad \text{Eq. 1)}$$

$$P = (32 \times wt.\ \%\ \text{Zn}) + (9 \times wt.\ \%\ \text{Ca}) + (4 \times wt.\ \%\ \text{Sn}) + 28 \text{ when } wt.\ \%\ \text{of } Sn > 2 \quad \text{Eq. 2)}$$

where P is the processability index, and P is from 20 to 150. P can be 20, 21, 22, 23, 24, 25, 26, 27, 28, 29, 30, 31, 32, 33, 34, 35, 36, 37, 38, 39, 40, 41, 42, 43, 44, 45, 46, 47, 48, 49, 50, 51, 52, 53, 54, 55, 56, 57, 58, 59, 60, 61, 62, 63, 64, 65, 66, 67, 68, 69, 70, 71, 72, 73, 74, 75, 76, 77, 78, 79, 80, 81, 82, 83, 84, 85, 86, 87, 88, 89, 90, 91, 92, 93, 94, 95, 96, 97, 98, 99, 100, 101, 102, 103, 104, 105, 106, 107, 108, 109, 110, 111, 112, 113, 114, 115, 116, 117, 118, 119, 120, 121, 122, 123, 124, 125, 126, 127, 128, 129, 130, 131, 132, 133, 134, 134, 136, 137, 138, 139, 140, 141, 142, 143, 144, 145, 146, 147, 148, 149 or 150 and can be within a range of any high value and low value selected from these values. For example, in Table 6, alloy Al5M with 2.10 wt. % Zn, and Sn level of 1.5 wt. % has a processability index P according to Equation 1 that is P=(32×2.10)+(9×0)+(18×1.5)=94.2.

The corrosion resistance of magnesium alloys can be improved by keeping impurity levels such as Fe, Cu, and Ni low. Additions of Li and Ge also can improve the corrosion resistance. These alloys are designed to be compatible with standard anticorrosion coating used in the industry.

Table 7 shows the measured yield strength and ductility of the invention alloys compared to the baseline alloy AM60B and AZ91D. The targeted values of the yield strengths (comparable that of AM60B) were achieved along with ductilities that are comparable to AM60B and better than AZ91D.

TABLE 7

Yield strength and elongation of invention alloys

| Alloy # | Alloy | Yield Strength (MPa) | Elongation to failure |
|---|---|---|---|
| Baseline Alloy | AZ91D | 158 | 6 |
| AI1M | AM60B | 97.7 | 21.2 |
| AI2M | AM60B + Zn | 94.4 | 23.0 |
| AI3M | AM60B + Sn | 98.6 | 18.0 |
| AI4M | AM60B + Zn + Sn | 92.6 | 17.9 |
| AI5M | AM50 + Zn + Sn | 103.6 | 18.9 |
| AI11M | AM60B + B | 117.3 | 22.6 |
| AI12M | AM60B + Zn + B | 107.6 | 21.8 |
| AI13M | AM60B + Sn + B | 124.9 | 23.9 |
| AI14M | AM60B + Zn + Sn + B | 132.2 | 21.4 |
| AI15M | AM50 + Zn + Sn + B | 133.4 | 24.7 |

The addition of 0.15 wt. % B (Al11M, Al12M, Al13M, Al14M, and Al15M) resulted in an improved yield strength (~20-43% increase) and increased elongation to failure (~6-30%) when compared to the alloys without the addition of B (Al1M, Al2M, Al3M, Al4M, and Al5M) due to grain refinement. Addition of B improves strength and ductility without compromising the processibility.

The ease of processing these alloys is characterized by the difference between the liquidus and solidus of these alloys and by the P values quantified in Equations 1 and 2. The alloys possess a liquid+solid range which provides good control on solid fraction at injection temperature. The alloys possess a fine grain size microstructure which provides good ductility while maintaining or improving strength over existing alloys used in thixomolding. The alloys further possess or improve on corrosion resistance relative to existing thixomolding alloys.

Figure 46:
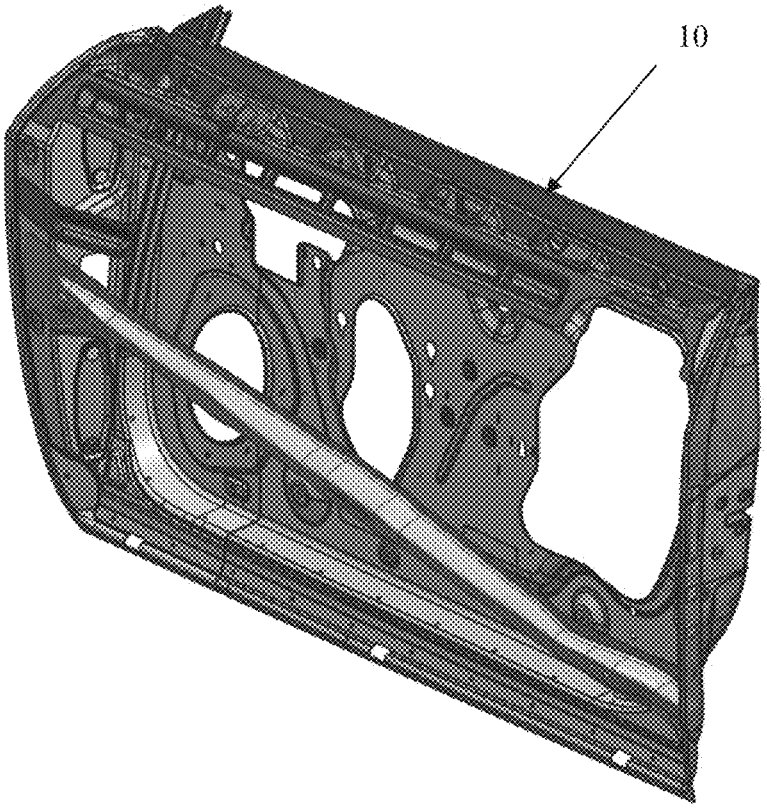
FIG. 46 is a perspective view of a large thixomolded automobile door component.

The alloys with a good combination of processability as indicated by the P values and with good strength and ductility, as shown in Table 7, are ideally suited for larger thixomolding operations such as for parts have largest dimensions of between 50 cm to 100 cm, thicknesses of between 2-4 mm, and weights of at least 3.6 kg. There is shown in FIG. 46 a door component 10 that can be cast by the alloys of the invention.

A method of preparing a thixomolded article can include the step of providing a magnesium alloy comprising, in weight percent Al: 4.5-6.5; Zn: 0.05-3.0; Ca: 0-1.5; Sn: 0-4.0; Mn: 0.1-0.5; Si: 0-0.5; B+Sr: 0-0.5; less than 0.1 Fe; less than 0.1 Cu; less than 0.01 Ni; and Mg: balance. The magnesium alloy is heated to a temperature of 500-600° C., producing a thixotropic alloy comprising 30-65 weight % solids. The thixotropic alloy is introduced into a mold under a pressure of 50-100 MPa. The thixotropic alloy is allowed to cool to produce a solid thixomolded article.

A method of preparing a thixomolded article can include the step of providing a magnesium alloy comprising, in weight percent Al: 4.5-6.5; Zn: 0.05-3.0; Ca: 0-1.5; Sn: 0-4.0; Mn: 0.1-0.5; Si: 0-0.5; B+Sr: 0-0.5; less than 0.1 Fe; less than 0.1 Cu; less than 0.01 Ni; and Mg: balance. The magnesium alloy is heated to a temperature of 500-600° C., producing a thixotropic alloy comprising 30-65 weight % solids. The thixotropic alloy is introduced into an open mold under ambient pressure. The mold is closed to compress the thixotropic alloy and thus fill the mold. The thixotropic alloy is allowed to cool to produce a solid thixomolded article.

A thixomolded article includes a magnesium alloy comprising, in weight percent Al: 4.5-6.5; Zn: 0.05-3.0; Ca: 0-1.5; Sn: 0-4.0; Mn: 0.1-0.5; Si: 0-0.5; B+Sr: 0-0.5; less than 0.1 Fe; less than 0.1 Cu; less than 0.01 Ni; and Mg: balance. The thixomolded article can have a weight of at least 3.6 kg and an average thickness of between 2.0 mm and 4.0 mm. The thixomolded article can have a largest dimension of between 50 cm and 200 cm. The thixomolded article can contain at least 1 molded-in connecting feature, the connecting feature provides a positive location function and structural strength of at least 70% of the base material strength, and the article is joined with other articles to produce an article with a mass of at least 7.2 kg.

The invention as shown in the drawings and described in detail herein disclose arrangements of elements of particular construction and configuration for illustrating preferred embodiments of structure and method of operation of the present invention. It is to be understood however, that elements of different construction and configuration and other arrangements thereof, other than those illustrated and described may be employed in accordance with the spirit of the invention, and such changes, alternations and modifications as would occur to those skilled in the art are considered to be within the scope of this invention as broadly defined in the appended claims. In addition, it is to be understood that the phraseology and terminology employed herein are for the purpose of description and should not be regarded as limiting.

We claim:

1. A magnesium alloy consisting of, in weight percent:
Al: 4.5-6.5;
Zn: 0.1-3.0;
Ca: 0-1.5;
Sn: 0-4.0;
Mn: 0.1-0.5;
Si: 0-0.5;
B+Sr: 0-0.5
less than 0.1 Fe
less than 0.1 Cu
less than 0.01 Ni; and,
Mg: balance, and wherein the alloy has a processability index P of from 25 to 150, where P is defined by Equations 1) and 2):

$$P=(32\times wt.\ \%\ Zn)+(9\times wt.\ \%\ Ca)+(18\times wt.\ \%\ Sn) \quad \text{when wt. \% of Sn} \leq 2 \qquad \text{Eq. 1)}$$

$$P=(32\times wt.\ \%\ Zn)+(9\times wt.\ \%\ Ca)+(4\times wt.\ \%\ Sn)+28 \quad \text{when wt. \% of Sn 2} \qquad \text{Eq. 2).}$$

2. The magnesium alloy of claim 1, wherein the alloy has a yield strength of at least 90 MPa.

3. The magnesium alloy of claim 1, wherein the alloy has a yield strength of at least 100 MPa.

4. The magnesium alloy of claim 1, wherein the alloy has a yield strength of at least 120 MPa.

5. The magnesium alloy of claim 1, wherein the elongation to failure is at least 16%.

6. The magnesium alloy of claim 1, wherein the elongation to failure is at least 20%.

7. The magnesium alloy of claim 1, wherein the alloy has a melting range of at least 200° C.

8. The magnesium alloy of claim 1, wherein the alloy has a melting range of at least 175° C.

9. The magnesium alloy of claim 1, wherein the alloy has a melting range of at least 150° C.

10. The magnesium alloy of claim 1, wherein the alloy has a melting range of at least 135° C.

11. A method of preparing a thixomolded article, comprising the steps of:

providing a magnesium alloy consisting of, in weight percent Al: 4.5-6.5; Zn: 0.1-3.0; Ca: 0-1.5; Sn: 0-4.0; Mn: 0.1-0.5; Si: 0-0.5; B+Sr: 0-0.5; less than 0.1 Fe; less than 0.1 Cu; less than 0.01 Ni; and Mg: balance;

heating the magnesium alloy to a temperature of 500-600° C., producing a thixotropic alloy comprising 30-65 weight % solids;

introducing the thixotropic alloy into a mold under a pressure of 50-100 MPa; and, allowing the thixotropic alloy to cool to produce a solid thixomolded article.

12. A method of preparing a thixomolded article, comprising the steps of:

providing a magnesium alloy consisting of, in weight percent Al: 4.5-6.5; Zn: 0.1-3.0; Ca: 0-1.5; Sn: 0-4.0; Mn: 0.1-0.5; Si: 0-0.5; B+Sr: 0-0.5; less than 0.1 Fe; less than 0.1 Cu; less than 0.01 Ni; and Mg: balance;

heating the magnesium alloy to a temperature of 500-600° C., producing a thixotropic alloy comprising 30-65 weight % solids;

introducing the thixotropic alloy into an open mold under ambient pressure;

closing the mold to compress the thixotropic alloy and thus fill the mold; and, allowing the thixotropic alloy to cool to produce a solid thixomolded article.

13. A thixomolded article, comprising a magnesium alloy consisting of, in weight percent Al: 4.5-6.5; Zn: 0.19-3.0; Ca: 0-1.5; Sn: 0-4.0; Mn: 0.1-0.5; Si: 0-0.5; B+Sr: 0-0.5; less than 0.1 Fe; less than 0.1 Cu; less than 0.01 Ni; and Mg: balance.

14. The thixomolded article of claim 13, wherein the article has a weight of at least 3.6 kg and an average thickness of between 2.0 mm and 4.0 mm.

15. The thixomolded article of claim 13, wherein the article has a largest dimension of between 50 cm and 200 cm.

16. The thixomolded article of claim 13, wherein the article contains at least 1 molded-in connecting feature, the connecting feature provides a positive location function and structural strength of at least 70% of the base material strength, and the article is joined with other articles to produce an article with a mass of at least 7.2 kg.

* * * * *